US007597505B2

(12) United States Patent
Price et al.

(10) Patent No.: US 7,597,505 B2
(45) Date of Patent: Oct. 6, 2009

(54) ROOF BOLT PLATE

(76) Inventors: Herbert S. Price, 600 Ironwood St., Green River, WY (US) 82935; David R. Marr, Jr., 501 Wabash St., Fort Collins, CO (US) 80526

( * ) Notice: Subject to any disclaimer, the term of this patent is extended or adjusted under 35 U.S.C. 154(b) by 50 days.

(21) Appl. No.: 11/391,820

(22) Filed: Mar. 28, 2006

(65) Prior Publication Data

US 2007/0231084 A1 Oct. 4, 2007

(51) Int. Cl.
*E21D 21/00* (2006.01)

(52) U.S. Cl. ..... 405/302.1; 405/259.1

(58) Field of Classification Search ..... 405/302.1, 405/259.1, 259.6, 288, 302.2
See application file for complete search history.

(56) References Cited

U.S. PATENT DOCUMENTS

| | | | | | |
|---|---|---|---|---|---|
| 1,930,632 | A | | 10/1933 | Topping | |
| 2,854,824 | A | | 10/1958 | Curry et al. | |
| 3,415,066 | A | * | 12/1968 | Williams | 405/302.1 |
| 4,293,243 | A | | 10/1981 | Graybeal et al. | |
| 4,451,179 | A | | 5/1984 | Bower, Jr. | |
| 4,558,547 | A | * | 12/1985 | Nieto | 52/223.13 |
| 4,581,712 | A | | 4/1986 | Perry et al. | |
| 4,630,974 | A | * | 12/1986 | Sherman | 405/259.1 |
| 4,819,393 | A | * | 4/1989 | Augoyard | 52/223.13 |
| 4,911,582 | A | * | 3/1990 | Peirce et al. | 405/262 |
| 4,954,018 | A | * | 9/1990 | Gauna | 405/259.1 |
| 5,147,151 | A | * | 9/1992 | Hipkins, Jr. | 405/259.1 |
| 5,292,209 | A | | 3/1994 | Calandra, Jr. et al. | |
| 5,345,742 | A | * | 9/1994 | Rogowsky et al. | 52/698 |
| 5,525,013 | A | | 6/1996 | Seegmiller et al. | |
| 5,542,788 | A | * | 8/1996 | Stankus et al. | 405/259.1 |
| 5,556,234 | A | | 9/1996 | Oldsen et al. | |
| 5,596,854 | A | * | 1/1997 | Crigler | 405/259.1 |
| 5,733,069 | A | | 3/1998 | Schofield, Jr. | |
| 5,791,828 | A | | 8/1998 | Fergusson | |
| RE35,902 | E | | 9/1998 | Calandra, Jr. et al. | |
| 5,803,693 | A | * | 9/1998 | Choiniere et al. | 405/302.1 |
| 5,934,855 | A | * | 8/1999 | Osterle et al. | 405/302.1 |
| 6,637,980 | B2 | | 10/2003 | Robertson, Jr. | |
| 6,682,268 | B2 | | 1/2004 | Robertson, Jr. et al. | |
| 2002/0064429 | A1 | | 5/2002 | Robertson, Jr. | |
| 2004/0115010 | A1 | | 6/2004 | Robertson, Jr. et al. | |
| 2005/0013672 | A1 | | 1/2005 | Slater | |
| 2005/0031420 | A1 | | 2/2005 | Domanski et al. | |
| 2005/0115188 | A1 | * | 6/2005 | Wallstein et al. | 52/698 |
| 2005/0201837 | A1 | * | 9/2005 | Stankus et al. | 405/302.1 |

* cited by examiner

*Primary Examiner*—Frederick L Lagman
(74) *Attorney, Agent, or Firm*—Clayton Howarth & Cannon, P.C.

(57) ABSTRACT

A support member for supporting a roof of a subsurface space. The support member may include a base portion for defining a surface area to contact a ceiling of the subsurface space. One or more sockets may extend from the base for defining openings for receiving roof bolts therethrough. Accordingly, the support member may be configured to function as a washer for the roof bolts to support the roof material above the ceiling. The sockets may include covers for preventing the roof bolts from extending out of the sockets. The sockets may be oriented at angles with respect to the base such that when roof bolts are placed in the sockets, the roof bolts may extend at angles with respect to each other in a splayed configuration.

71 Claims, 34 Drawing Sheets

ROOF BOLT PLATE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Invention

The present disclosure relates generally to support devices used for subsurface materials, and more particularly, but not necessarily entirely, to devices, sometimes referred to as roof plates, for receiving roof bolts to assist in preventing roofs of underground mines from caving in.

2. Description of Related Art

It is common practice in the mining industry to support underground mine roofs with support members to prevent roof cave-ins. One method of supporting underground mine roofs includes attaching lower levels rock strata to upper layers of rock using roof bolts. Roof bolts may vary in length and diameter, but may typically be sized one-half inch or more in diameter and 30 inches to 12 feet or more in length. Other varieties of roof bolts, such as cable bolts, may be 10 to 24 feet in length, for example. The roof bolts may be formed as rigid members such as rebar or threaded rod bolts, or the roof bolts may be formed as multi-strand cable bolts. Holes may be drilled in the ceiling of a mine and the roof bolts may be inserted to tie the rock strata in the ceiling with upper layers of rock.

Some embodiments of roof bolts may also include use of epoxy or polyester resins and various types of cement. After a hole is placed in the mine ceiling, an epoxy or polyester resin in a pliable plastic tube may be inserted in the hole. Next, a roof bolt may be inserted in the hole which may tear the packaging for the epoxy or polyester resin and allow the resin to mix and spread to the surrounding rock layers. The resin may set up or harden within a matter of seconds to thereby seal the bolt to the rock layers. Cements are much slower in setting and are, therefore, used where setting time is not critical.

A support member, commonly referred to as a bearing plate or a roof bolt plate, may be placed on the mine ceiling and held in place by a head or nut on the roof bolt. In cases where a threaded nut is used, it is tightened to bring the roof bolt plate snugly against the mine ceiling. The plate thereby functions as a washer to prevent the roof bolt from being drawn into the bolt hole in the ceiling of the mine. The roof bolts may be spaced at specified intervals along the mine ceiling, such as every four feet, for example, to provide adequate support to the mine roof. Accordingly, cave-ins in the mine may be prevented and the mine may be safely accessed.

Despite the advantages of the known roof bolt plate systems, improvements are still being sought. For example, roof bolts are known to break, thereby causing a portion of the bolt to be ejected from the ceiling causing a safety hazard. Attempts have been made to prevent the roof bolts from shooting out of the ceiling and causing a safety hazard. For example, a wire mesh, such as a chain link material and/or a rubber matting material, may be place over the ceiling to hold the roof bolts in the ceiling in the event the roof bolts are broken. However, the cost of materials and labor required to install wire mesh and rubber matting may be high.

Also, when a roof bolt breaks, a replacement roof bolt will usually have to be installed in close proximity to the broken bolt. This may add to the cost and time required to stabilize a roof. Additionally, the number of locations suitable for the roof bolt plates may be limited. Moreover, the loads supportable by the known roof bolt plate systems may be limited such that the prior art roof bolt plates may not be suitable in some situations. For example, the known roof bolt plate systems may not be effective in supporting soft or plastic soils.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
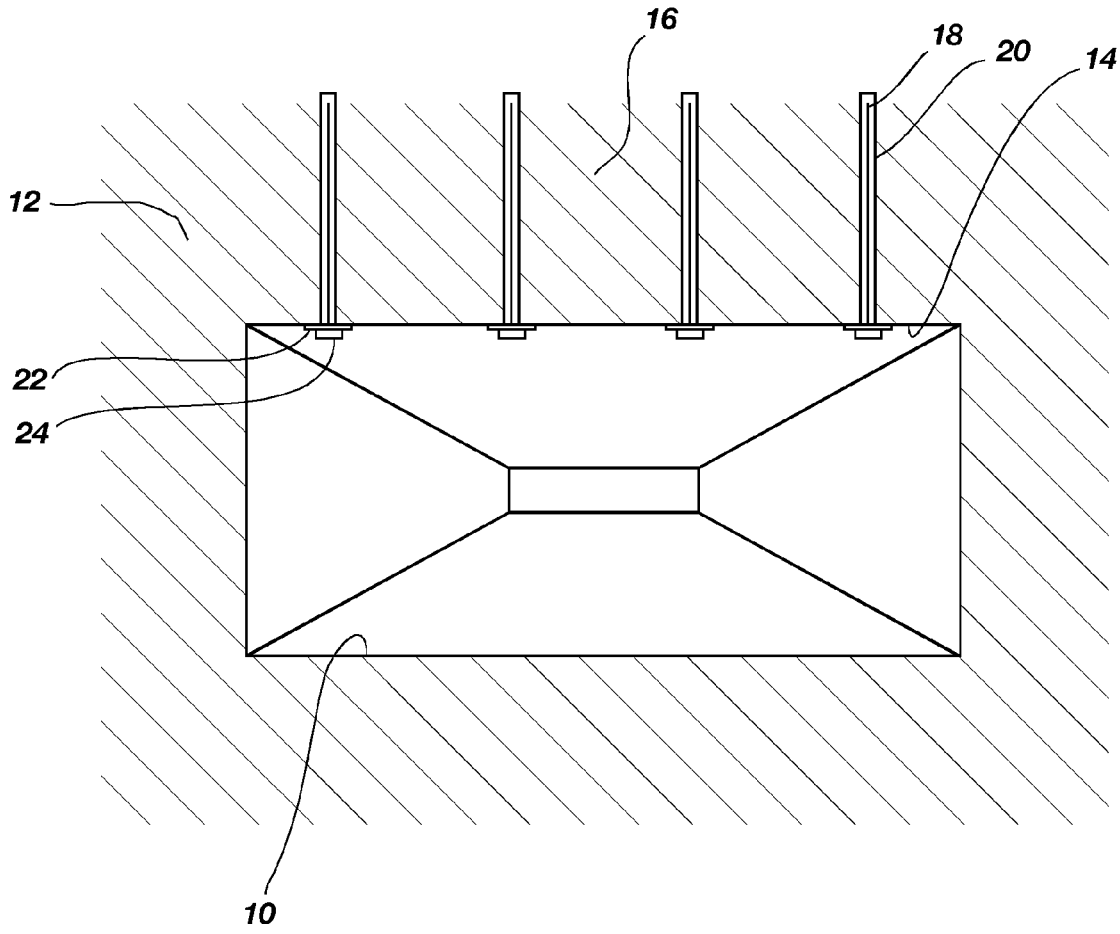
FIG. 1 is a schematic cross-sectional view of a mine tunnel supported with roof bolts.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. Moreover, in describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

As referred to herein, the term "subsurface" shall be construed broadly to include areas or volumes beneath or beyond a surface, including but not limited to the surface of the earth and surfaces of manufactured structures, such that the subsurface may extend upwardly, downwardly or laterally beyond the surface.

The term "space" as used herein shall be construed broadly to include an extent or expanse of a surface or three-dimensional area, including but not limited to the expanse defining a mine, tunnel, channel, chamber, passage, cavern, cave, or above ground feature, for example.

As used herein, the term "ceiling" shall be construed broadly to include an interior surface defining a space.

The term "roof" as used herein, shall be construed broadly to include material extending beyond a ceiling in a direction towards an exterior of a space.

Referring now to FIG. 1, a schematic cross-sectional view is shown of a space or tunnel 10 formed in a subsurface material 12. The tunnel 10 may form part of an underground mine, or the tunnel 10 may form part of any other subsurface space known to those skilled in the art. Accordingly, the tunnel 10 may be formed in any manner known to those skilled in the art in any suitable shape and size. The subsurface material 12 may include any variety of material suitable for forming a tunnel, such as rock or earthen material for example.

The tunnel 10 may include a material surface, or ceiling 14 defining an interior surface of the tunnel 10. Also, a roof 16 may be formed in the subsurface material 12 beyond the ceiling 14. It will be understood that although the ceiling 14 is depicted at the top of the tunnel 10 as shown in FIG. 1, the present disclosure may be applicable to the sides and bottom of the tunnel 10 as well. Accordingly, the ceiling 14 and roof 16 need not necessarily be in the top of the tunnel 10 as shown.

Roof bolts 18 may be placed in the subsurface material 12 to support the roof 16 by attaching lower levels of subsurface material 12, such as rock strata, to upper levels of subsurface material 12. The roof bolts 18 may vary in length and diameter, and may typically be sized one-half inch or more in diameter and 30 inches to 24 feet or more in length. The roof bolts 18 may be formed as rigid members such as rebar or threaded rod bolts, or the roof bolts 18 may be formed as multi-strand cable bolts, or the roof bolts 18 may be formed in any other suitable manner known to those skilled in the art.

Holes 20 may be drilled in the subsurface material 12 through the ceiling 14 of the tunnel 10, and the roof bolts 18 may be inserted into the holes 20 to tie the subsurface material 12 together and thereby support the roof 16.

As discussed above, some embodiments of roof bolts 18 may also include use of epoxy resins. After the hole 20 is formed in the roof 16, an epoxy or polyester resin in a pliable plastic tube may be inserted in the hole 20. Next, a roof bolt 18 may be inserted in the hole 20 which may tear the packaging for the epoxy resin and allow the resin to mix and spread to the surrounding rock layers in the subsurface material 12. In some embodiments, a drilling machine may be used to spin the roof bolt 18 for a period of time, such as approximately 10 seconds for example, to mix the resin. The bolt may then be held for a period of time, such as 5 seconds for example. The resin may set up or harden within a matter of seconds to thereby seal the roof bolt 18 to the subsurface material 12.

A bearing plate 22 or roof bolt plate, may be placed on the mine ceiling 14 and held in place by a head 24 or nut on the roof bolt 18. In cases where a threaded nut is used, it can be tightened thus bringing the bearing plate 22 snugly against the mine ceiling 14, to thereby spread the load of the roof bolt 18 over a large enough area of the ceiling 14 to function as a washer to prevent the roof bolt 18 from being drawn into the bolt hole 20 in the ceiling 14 of the tunnel 10. Typical bearing plates may be approximately 6 inches square, for example, and may form a node for receiving the roof bolt 18. The roof bolts 18 may be spaced at specified intervals along the mine ceiling 14, such as every four feet, for example, to provide adequate support to the mine roof 16. Accordingly, cave-ins in the tunnel 10 may be prevented and the tunnel 10 may be safely accessed.

Figure 2:
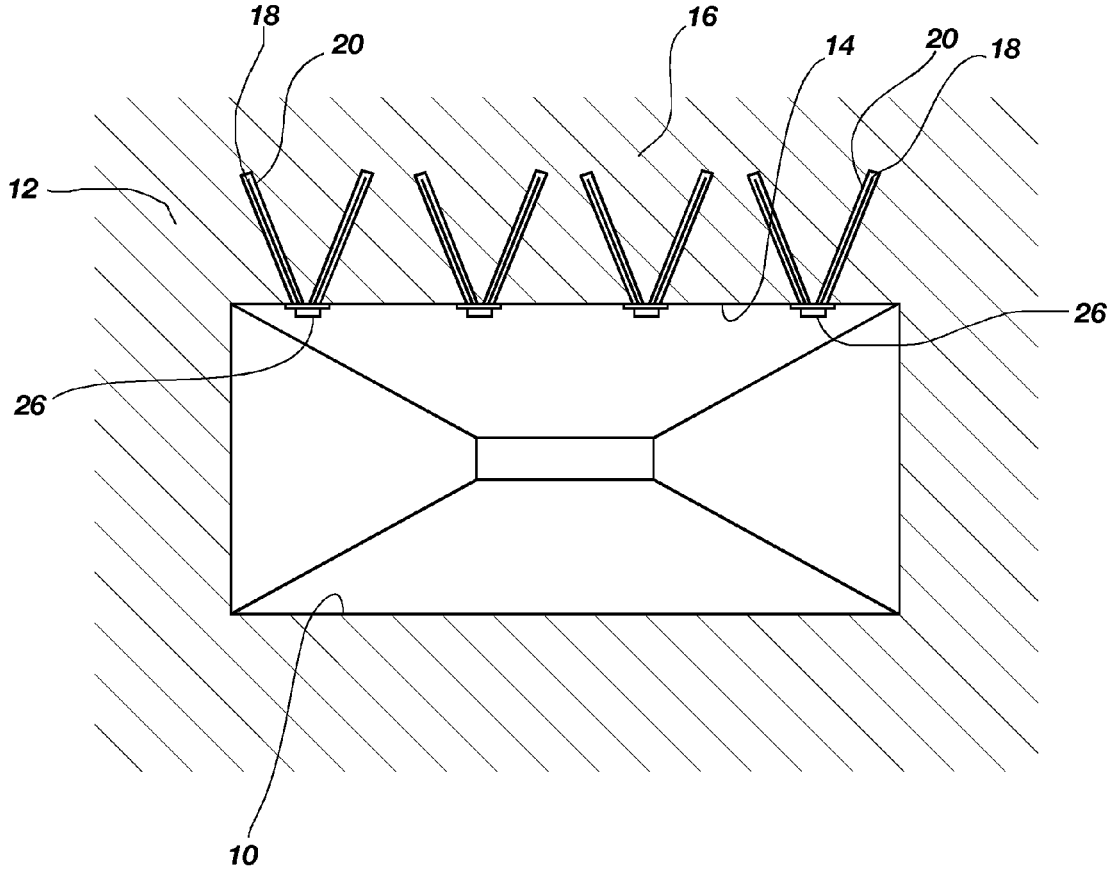
FIG. 2 is a schematic cross-sectional view of a mine tunnel supported with roof bolts and a roof bolt plate in accordance with the principles of the present disclosure.

Referring to FIG. 2, the tunnel 10 is shown similar to the depiction of FIG. 1, except that support members 26, also referred to as roof bolt plates, or fixtures, are shown in accordance with the principles of the present disclosure. It will be appreciated that FIG. 2 contains many of the same features as those represented in FIG. 1, and only the new or different features will be discussed to most succinctly explain the embodiment of the disclosure illustrated in FIG. 2. One or more of the support members 26 may be positioned on the ceiling 14 of the tunnel 10 for receiving one or more roof bolts 18. Accordingly, each support member 26 may form a node on the ceiling for receiving one or more roof bolts 18.

Figure 3:
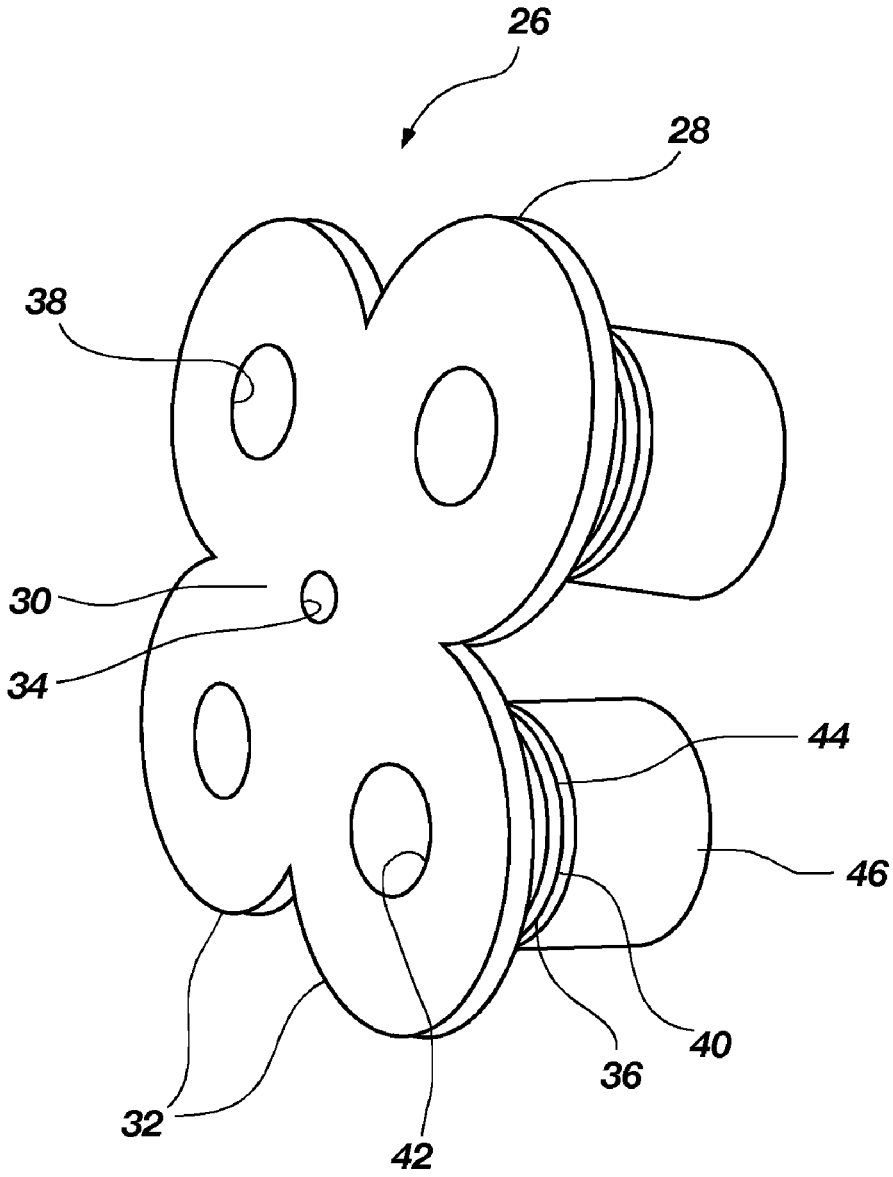
FIG. 3 is a rear perspective view of a roof bolt plate in accordance with the principles of the present disclosure.

A rear perspective view of one embodiment of a support member, indicated generally at 26, is shown in FIG. 3. The support member 26 may include a base 28 for defining a surface for contacting the ceiling 14 of the tunnel 10. The base 28 may be formed in various different shapes, sizes and thicknesses and may be formed of materials-known in the art to provide suitable strength and durability characteristics. One embodiment of the base 28 may include a central portion 30 that may be substantially planar. The base 28 may include one or more extensions 32 surrounding the central portion 30. The extensions 32 may be rounded lobes or the extensions may be formed in other configurations within the scope of the present disclosure.

The base 28 may also include one or more fastener openings 34 for receiving a fastener (not shown) for fastening the support member 26 to the ceiling 14 of the tunnel 10. The fastener may include a bolt that may be relatively short as compared to the roof bolts 18, such as two to four feet in length, for example. This feature allows the installer to fix the support member 26 to the ceiling 14 before the holes 20 are drilled into the roof 16 for the roof bolts 18. The fastener openings 34 may be located in the central portion 30, or the fastener openings 34 may be positioned at other suitable locations on the support member 26. It will be understood that various quantities of fastener openings 34 may be provided on the support member 26, or alternatively, some embodiments of the support member 26 may not include any fastener openings. As shown in FIG. 3, one embodiment of the present disclosure may include a single fastener opening having a diameter of between ¾ to one inch, for example. It will be understood, however, that the fastener opening 34 may be formed in various different sizes and configurations within the scope of the present disclosure.

The support member 26 may also include one or more sockets 36 extending from the base 28. Each of the sockets 36 may define an opening 38 for receiving a roof bolt 18 therethrough for supporting the roof 16 of the tunnel 10. The sockets 36 may be formed of a sidewall 40 having an interior surface 42 defining the opening 38, and an exterior surface 44. One embodiment of the socket 36 may be formed as a short piece of pipe fixedly joined to the base 28. It will be understood that the phrase "extending from" as referred to herein, such as a socket 36 "extending from" the base 28, shall be understood to mean that the socket 28 runs, projects or reaches beyond the base 28, such that the socket 36 may not be formed as merely an opening in the base 28 itself. Rather, the sidewall 40 defining the socket 36 may project beyond the base 28. It will also be understood that alternative embodiments of the present disclosure may include a socket that may be formed integral and coextensive with the base 28 such that the socket may not extend from the base 28.

A cover 46 may be placed on the socket 36 to prevent a roof bolt 18 from exiting the socket 36. One embodiment of the socket 36 may include threads on the exterior surface 44 such that the cover 46 may be threadably engaged with the socket 36 to maintain the cover 46 on the socket 36. It will be understood that the cover 46 may be attached to the socket 36 using other attachment mechanisms known in the art, such that the cover 46 may be removably attachable to the socket 36. Alternative embodiments of the present disclosure may include covers that may be permanently attached to the socket 36.

Figure 4:
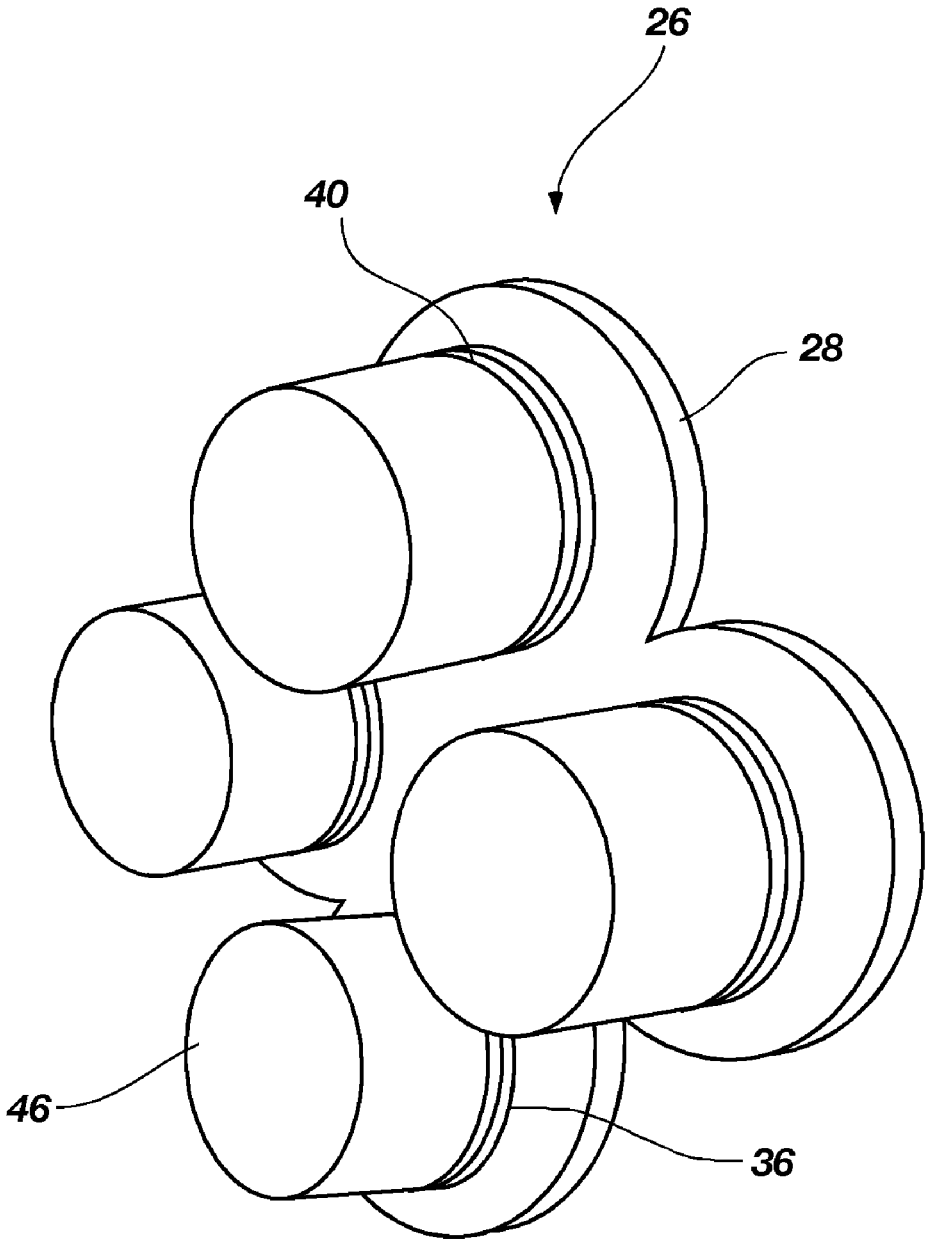
FIG. 4 is a front perspective view of the roof bolt plate of FIG. 3.
Figure 4A:
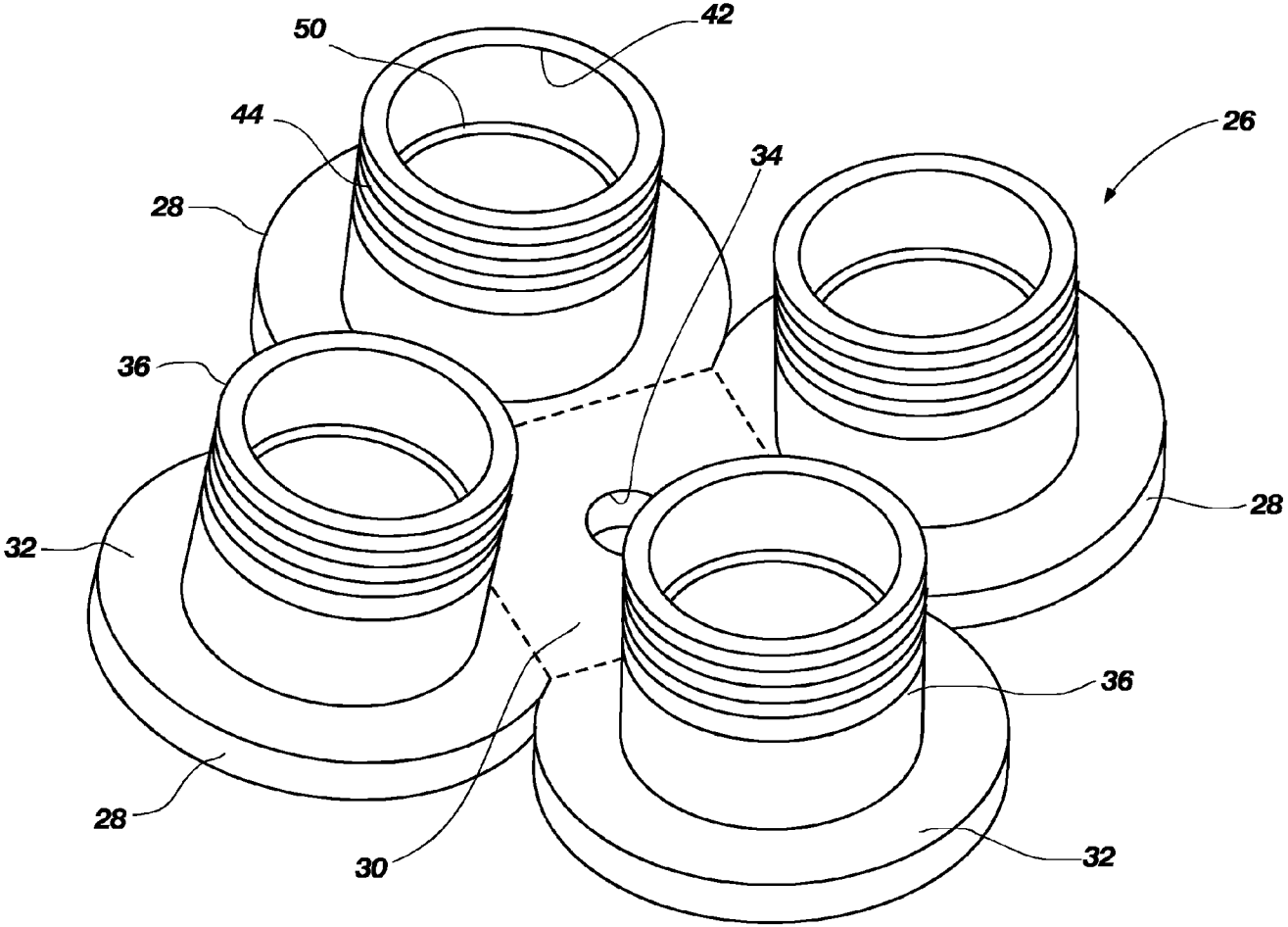
FIG. 4*a* is a front perspective view of the roof bolt plate of FIG. 4 with covers removed.

As shown most clearly in FIG. 4, the cover 46 may extend over an entire end of the socket 36. However, it will be understood that the cover 46 may have various different configurations, and may include one or more openings such that the interior of the socket 36 may be accessible, at least in part, even if the cover 46 is attached to the socket 36. Moreover, as shown in FIG. 4*a*, the covers 46 may be removed from the sockets 36 to access an interior of the sockets 36.

Figure 5:
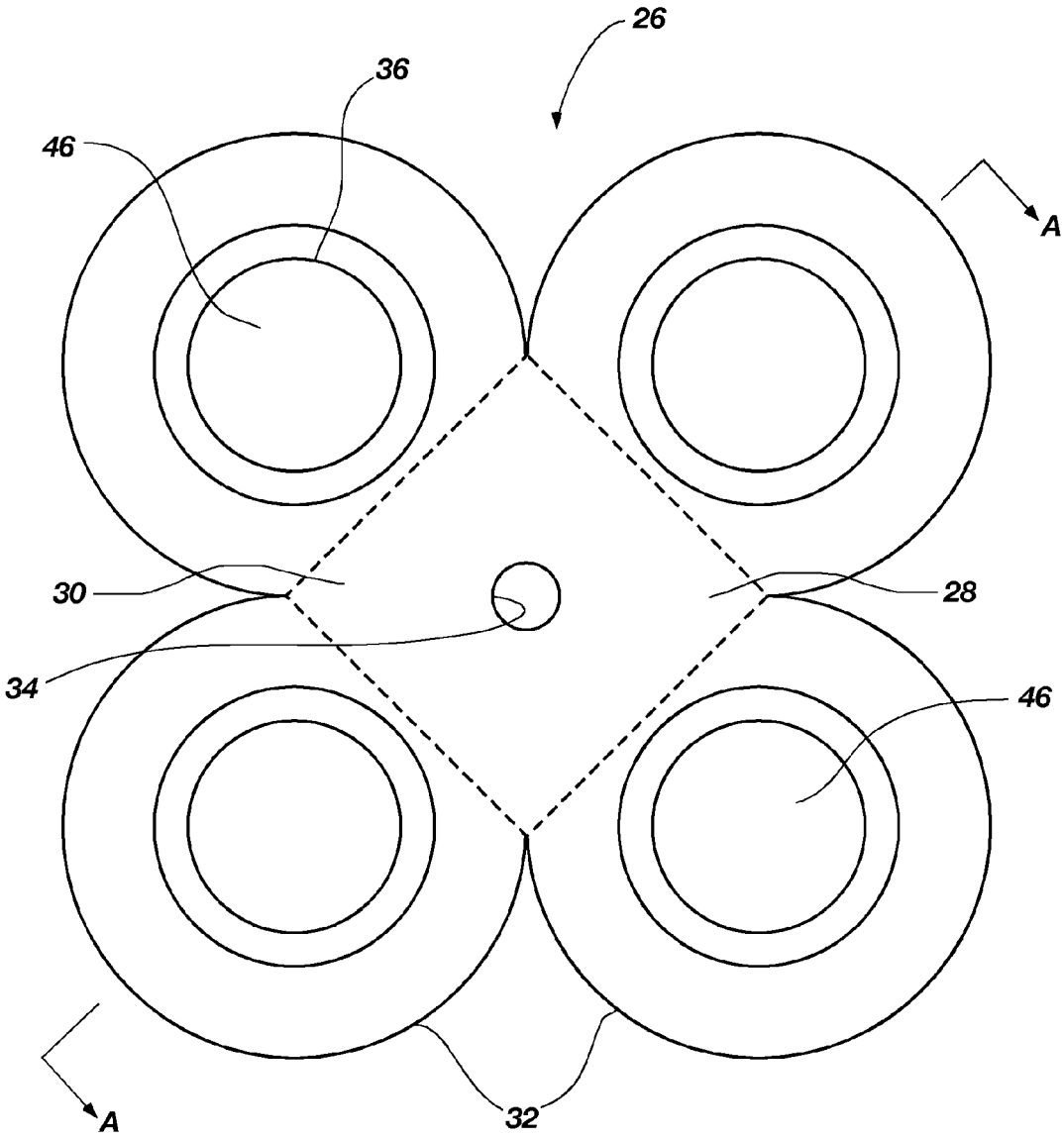
FIG. 5 is a plan view of the roof bolt plate of FIG. 4.
Figure 6:
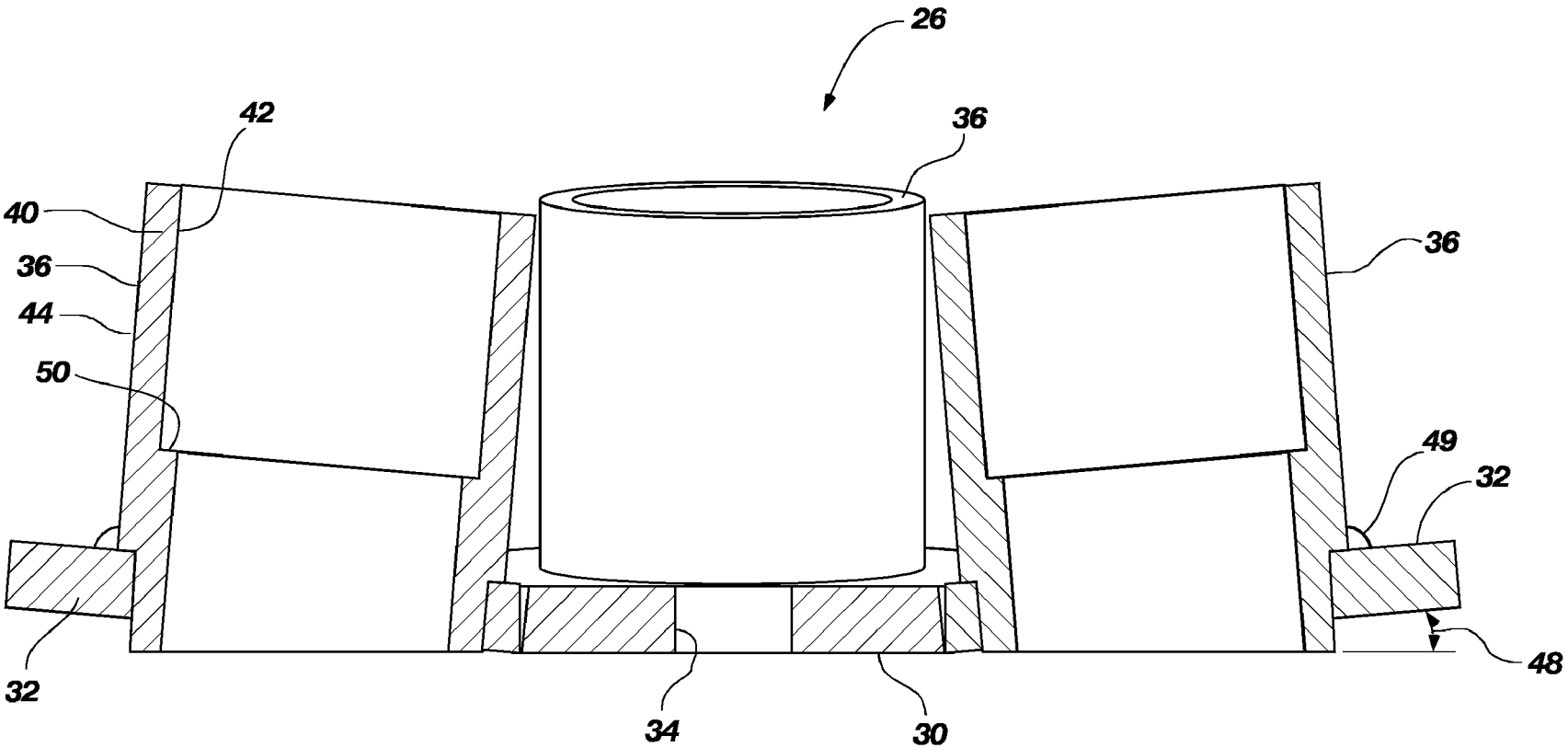
FIG. 6 is a side cross-sectional view of a roof bolt plate taken along line A-A in FIG. 5.

Referring to FIG. 5, a plan view of the support member 26 is shown. A side cross-sectional view of the support member 26, taken along line A-A in FIG. 5, is shown in FIG. 6. In one embodiment, the sockets 36 may be joined to the base 28 by a weld 49. However, it will be understood that various different methods and structures known in the art may be used to join the socket 36 to the base 28. Moreover, in one embodiment, the sockets 36 may be integrally formed with the base 28 such that the support member 26 is a one-piece, unitary member. Alternatively, the sockets 36 may be removably joined to the base 28.

One embodiment of the support member 26 may be formed such that the extensions 32 may project at an angle with respect to the central portion 30. For example, the extensions 32 may project at an angle 48 that may be greater than 0 degrees, and less than 25 degrees. One embodiment may include extensions 32 that may project at an angle 48 of approximately 5 degrees with respect to the central portion 30. It will be understood, however, that the extensions 32 may project at various other angles within the scope of the present disclosure, and some embodiments of the extensions 32 may be co-planar with respect to the central portion 30. It will be appreciated that the support member 26 may be manufactured with the extensions 32 oriented at a pre-determined position so as to facilitate installation of the roof bolts 18. Moreover, the quality of the installation of the roof bolts 18 may be more easily controlled to maintain the maximum strength achievable by the support member 26.

The angled extensions 32 may allow the roof bolts 18 to be directed in a non-parallel direction such that an end of the roof bolts 18 furthest from the support member 26 may be spaced further apart than the head of the roof bolts 18 in the support member, to thereby form a splayed configuration, as shown most clearly in FIG. 2. Accordingly, the support member 26 may be configured to receive the roof bolts 18 in a splayed manner in which the heads of the roof bolts 18 may converge and be in close proximity to each other, whereas the ends of the roof bolts 18 may diverge and be spaced further apart. For example, one embodiment of the present disclosure may allow the heads of the roof bolts 18 to be spaced apart by approximately four inches, whereas the ends of the roof bolts 18 furthest from the support member 26 may be spaced apart by approximately four feet. This technique may be used to spread the stress that the roof bolts 18 place on the upper strata of the roof 16 over a larger area, thereby greatly increasing the potential force that the roof bolts 18 can place on the roof 16. Accordingly, more than a single roof bolt 18 may be positioned in a support member 26 to enhance the support provided by the support member 26 into the subsurface material 12 forming the tunnel 10.

It will be understood that the embodiment of the support member 26 depicted in FIGS. 3-5 may include four sockets 36 for receiving up to four roof bolts 18 to provide enhanced support capabilities of the support member 26. It will be understood, however, that other number of sockets 36 may be provided on the support member 26, and that roof bolts 18 need not be placed in each of the sockets 36. For example, the support member 26 having four sockets 36 may allow roof bolts 18 to be installed at different time intervals. Two roof bolts 18 may be installed initially, and if one or both of the roof bolts 18 fail, additional roof bolts 18 may be installed in the remaining sockets 36 without removing or replacing the support member 26. Accordingly, the configuration of the support member 26 may allow for versatile use.

As shown in FIG. 6, the interior surface 42 of the socket 36 may be counter bored to define a seat or stop 50 for abutting with a head 24 of the roof bolts 18 for limiting movement of the roof bolts 18 into the socket 36. Moreover, the stop 50 may provide a surface area for transferring a force from the roof bolts 18 to the support member 26, such that a tensile force from the roof bolts 18 may be transferred to the base 28 and into the ceiling 14 of the tunnel 10.

Figure 7:
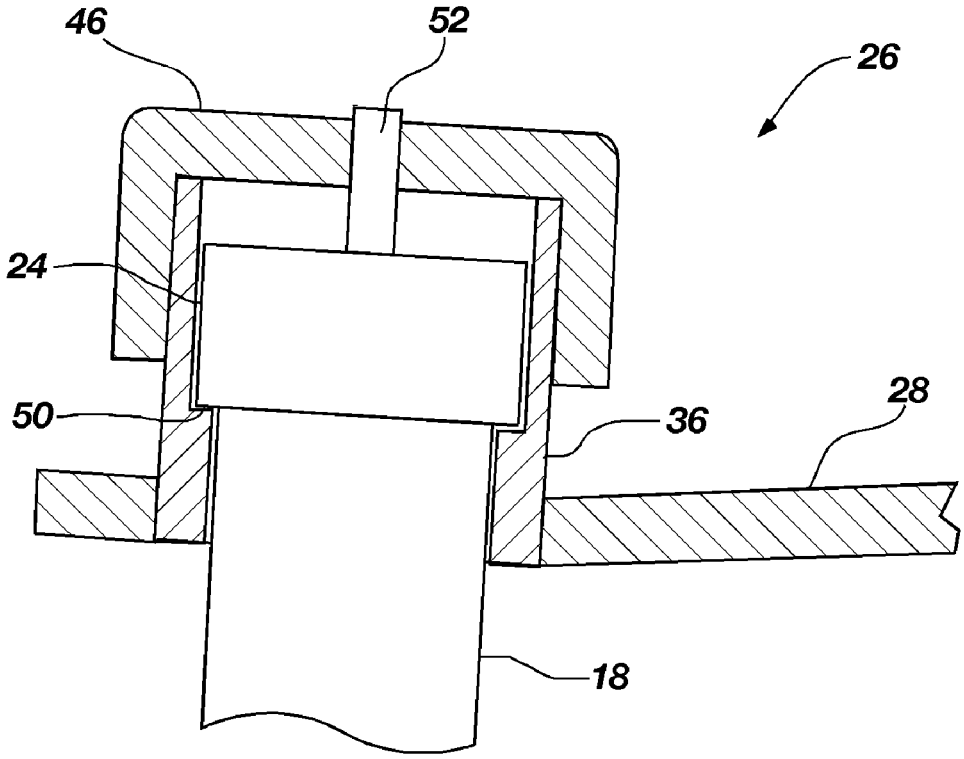
FIG. 7 is a break-away cross sectional view of a roof bolt plate having a roof bolt and cover.

Referring to FIG. 7, a break-away cross sectional view is shown of a support member 26 having a roof bolt 18 installed in the socket 36, and a cover 46 attached to the socket 36. An indicator 52 may be utilized to show if the roof bolt 18 has broken. Roof bolts 18 are commonly subjected to significant loads. For example, some roof bolts 18 may have a breaking strength of approximately 60,000 pounds, such that if the roof bolt 18 is subjected to an excessive force, the roof bolt 18 may break. When a roof bolt 18 breaks, high tensile forces acting on the roof bolt 18 may cause the roof bolt 18 to shoot out of the hole 20. Roof bolts may thereby create a safety risk, or the roof bolts may cause damage to items within the tunnel 10 if not properly constrained.

The indicator 52 may be formed as a pin or rollpin positioned in a hole in the cover 46. One embodiment of the indicator may be located in a center of the cover 46. After the roof bolt 18 has been installed through the socket 36, and the cover 46 has been placed on the socket 36, the pin may be tapped against the head of the roof bolt 18. Accordingly, if the roof bolt 18 breaks, the pin may be pushed to an extended position where it may serve as a visual indicator that the roof bolt 18 has broken. Removal of the cover 46 at this point may be a dangerous procedure without additional safety precautions. It will be understood that the indicator 52 may be formed in various different configurations within the scope of the present disclosure. For example, some embodiments of the indicator 52 may be removable from the cover 46, whereas other embodiments of the indicator 52 may be provided with a mechanism to prevent the indicator 52 from separating from the cover 46.

One exemplary embodiment of the support member 26 may include a base 28 formed of a half inch thick plate material. Four sockets 36 may be spaced approximately 4.5 inches apart from center to center in a substantially square configuration. The sockets 36 may be welded to the extensions 32, and the extensions 32 may be sized approximately 4.5 inches in diameter. The sockets 36 may be formed having a 2 inch inner diameter, and a 2.25 inch inner diameter counter bore to form the stop 50. The central portion 30 of the base 28 may be configured to be substantially planar and approximately 3.18 inches square. The extensions 32 may project at an angle of approximately 5 degrees from the central portion 30. It will be appreciated, however, that the support member 26 may be formed in various other configurations and dimensions within the scope of the present disclosure, and the above described embodiment is for illustrative purposes only.

It will be understood that one feature of the present disclosure is that the support member 26 may form a guide for installation of the roof bolts 18. For example, once the support member 26 is attached to the ceiling 14 with a fastener through the fastener opening 34, a drill bit may be inserted through the sockets 36 to guide the drill bit in forming the hole 20 in the subsurface material 12. The sockets 36 may also be extended by coupling a pipe on an end of the socket 36 to provide additional support for a drill bit if desired. For example, a standard pipe, about 18 inches long, may be coupled to the threads on the exterior of the sockets 36 to thereby extend the length of the sockets 36 to facilitate guiding a drill bit into the subsurface material 12 for forming the holes 20.

Once the holes 20 have been formed in the subsurface material 12, the roof bolts 18 may be installed through the sockets 36 in a manner known to those skilled in the art. It will be understood, however, that in some embodiments, the holes 20 may be formed as the roof bolts 18 are installed. After the roof bolts 18 are installed through the sockets 36, covers 46 may be placed over the sockets 36 to maintain the roof bolts 18 within the sockets 36. The roof bolts 18 may pull the support member 26 against the ceiling 14 and provide support to the subsurface material 12.

It will be understood that the support member 26 may be utilized to provide an economical manner of securing soft or weak strata in the subsurface material 12 above the tunnel 10, such that material may be safely mined in areas that may otherwise not be economical to mine. Also, the support member 26 may be used to greatly enhance personal safety in the tunnel 10. The support member 26 may utilize a relatively simple design, and the support member 26 may be manufactured from known, readily accessible materials having suitable strength and durability characteristics. Moreover, the support member 26 may be manufactured using known procedures such that the support members 26 may be produced at a reasonable cost. Accordingly, the potential benefit of the support members 26 in terms of economical recovery of materials from a mine is great in comparison to the cost of the support members 26.

It will also be understood that the principles of the present disclosure may be used in above-ground, or surface uses. For example, the support members 26 may be useful in stabilizing slopes along roadways or near structures, or in surface mining applications. Accordingly, the principles of the present disclosure are not restricted to underground mines or tunnels.

Figure 8:
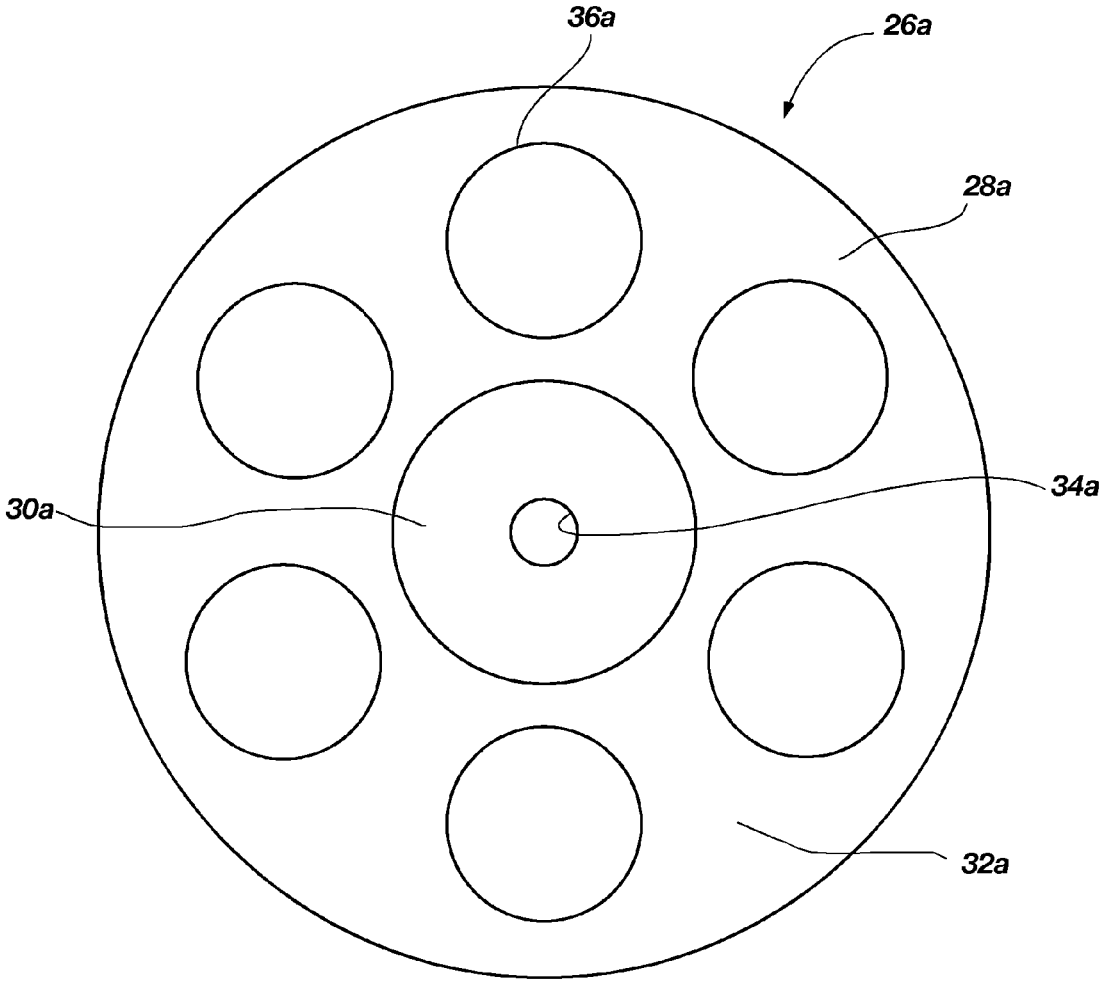
FIG. 8 is a plan view of an alternative embodiment roof bolt plate.

Reference will now be made to FIG. 8 to describe an alternative embodiment of the present disclosure. As previously discussed, the presently disclosed embodiments of the disclosure illustrated herein are merely exemplary of the possible embodiments of the disclosure, including that illustrated in FIG. 8.

It will be appreciated that the alternative embodiment of the disclosure illustrated in FIG. 8 contains many of the same structures represented in FIGS. 1-7 and only the new or different structures will be explained to most succinctly explain the features which come with the embodiments of the disclosure illustrated in FIG. 8.

FIG. 8 illustrates a plan view of an alternative embodiment support member, indicated generally at **26*a*. The alternative embodiment support member 26*a* may include a base 28*a***.

The base 28*a* may be circular in shape, or the base 28*a* may have any other suitable shape within the scope of the present disclosure. Accordingly, the base 28*a* may be formed without discrete lobes as disclosed in the previous embodiments. Rather, the base 28*a* may include a single extension 32*a*. The base 28*a* may include a central portion 30*a* having a fastener opening 34*a*. The extension 32*a* may extend at an angle with respect to the central portion 30*a* similar to the embodiments previously discussed. Moreover, the alternative embodiment support member 26*a* may have a plurality of sockets 36*a*, such as six sockets 36*a*, for example, for receiving roof bolts 18. It will also be understood that the alternative embodiment support member 26*a* may have other quantities of sockets 36*a* within the scope of the present disclosure. It will be understood that the alternative embodiment support member 26*a* may be used in a manner similar to the previously discussed embodiments.

Figure 9D:
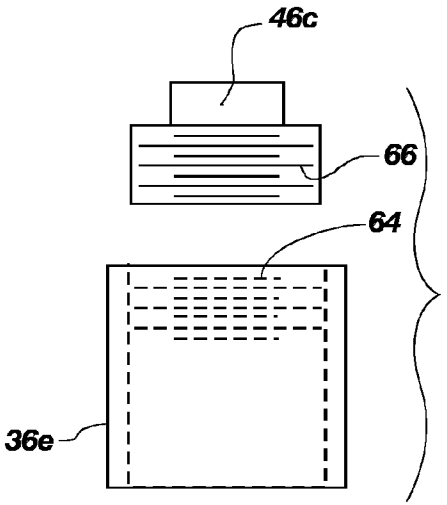
FIG. 9D is a side view of an additional alternative embodiment socket and cover.
Figure 9C:
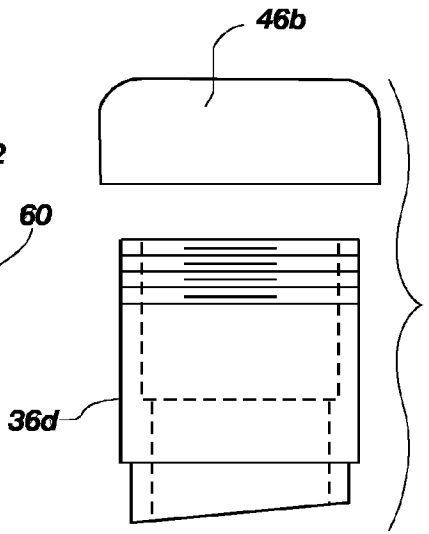
FIG. 9C is a side view of a further alternative embodiment socket and cover.
Figure 9B:
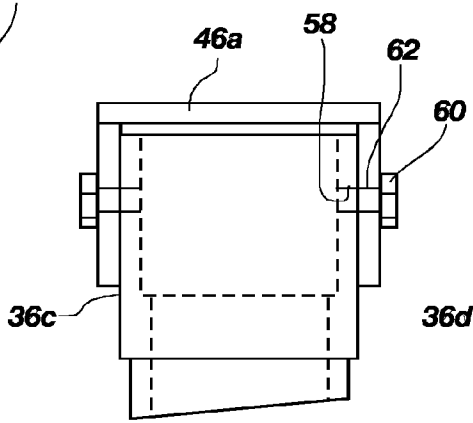
FIG. 9B is a side view of an additional alternative embodiment socket and cover.
Figure 9A:
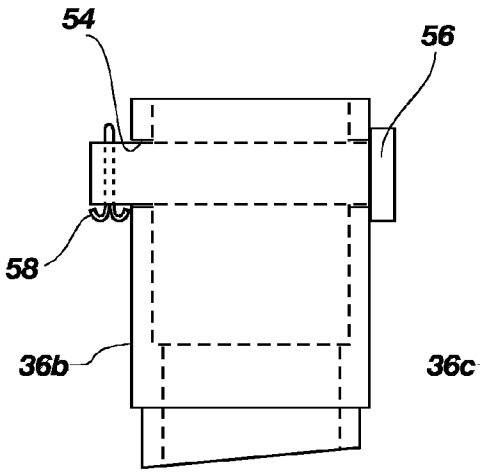
FIG. 9A is a side view of an alternative embodiment socket and cover.

Referring now to FIGS. 9A-9D, side views are shown of alternative embodiments of the socket, indicated at 36*b*-36*e*, respectively. In FIG. 9A, the socket 36*b* may include a pin opening 54 for receiving a socket pin 56. The socket pin 56 may be inserted in the pin opening 54 to prevent the roof bolt 18 from exiting the socket 36*b*. The socket pin 56 may be held in place in the socket 36*b* by a cotter pin 58 or any other suitable clip or fastener known to those skilled in the art. Accordingly, the socket pin 56 may block passage of the roof bolt 18 through the socket 36*b*, while allowing the roof bolt 18 to be viewed through an end of the socket 36*b*.

As shown in FIG. 9B, an additional alternative embodiment socket 36*c* may include fastener openings 58 for receiving fasteners 60, such as screws or bolts. A cover 46*a* may be provided with corresponding openings 62, such that the cover 46*a* may be placed on the socket 36*c*, and the corresponding openings 62 in the cover 46*a* may be aligned with the fastener openings 58. Fasteners 60 may then be inserted to fasten the cover 46*a* to the socket 36*c*. It will be understood that any number of fastener openings 58 and fasteners 60 may be used to attach the cover 46*a* to the socket 36*c* within the scope of the present disclosure.

Referring to FIG. 9C, an additional alternative embodiment socket 36*d* and cover 46*b* is shown. It will be understood that the embodiment shown in FIG. 9C may include many of the features of the embodiments previously discussed. As shown in FIG. 9C, the cover 46*b* may have a different shape, including a smaller dimensioned height, having rounded corners. It will be understood that the cover 46*b* may have various other configurations within the scope of the present disclosure.

As shown in FIG. 9D, an additional alternative socket 36*e* may include internal threads 64, and the cover 46*c* may have corresponding external threads 66. The cover 46*c* may also include a driving surface 68, for joining with a tool for rotating the cover 46*c*. The driving surface 68 may have various different configurations known in the art, such as polygonal shaped exterior surfaces, or various different shaped recesses, for joining with a driving tool. Accordingly, the cover 46*c* may be rotated into the socket 36*e* to thereby cover the socket 36*e*.

Figure 10:
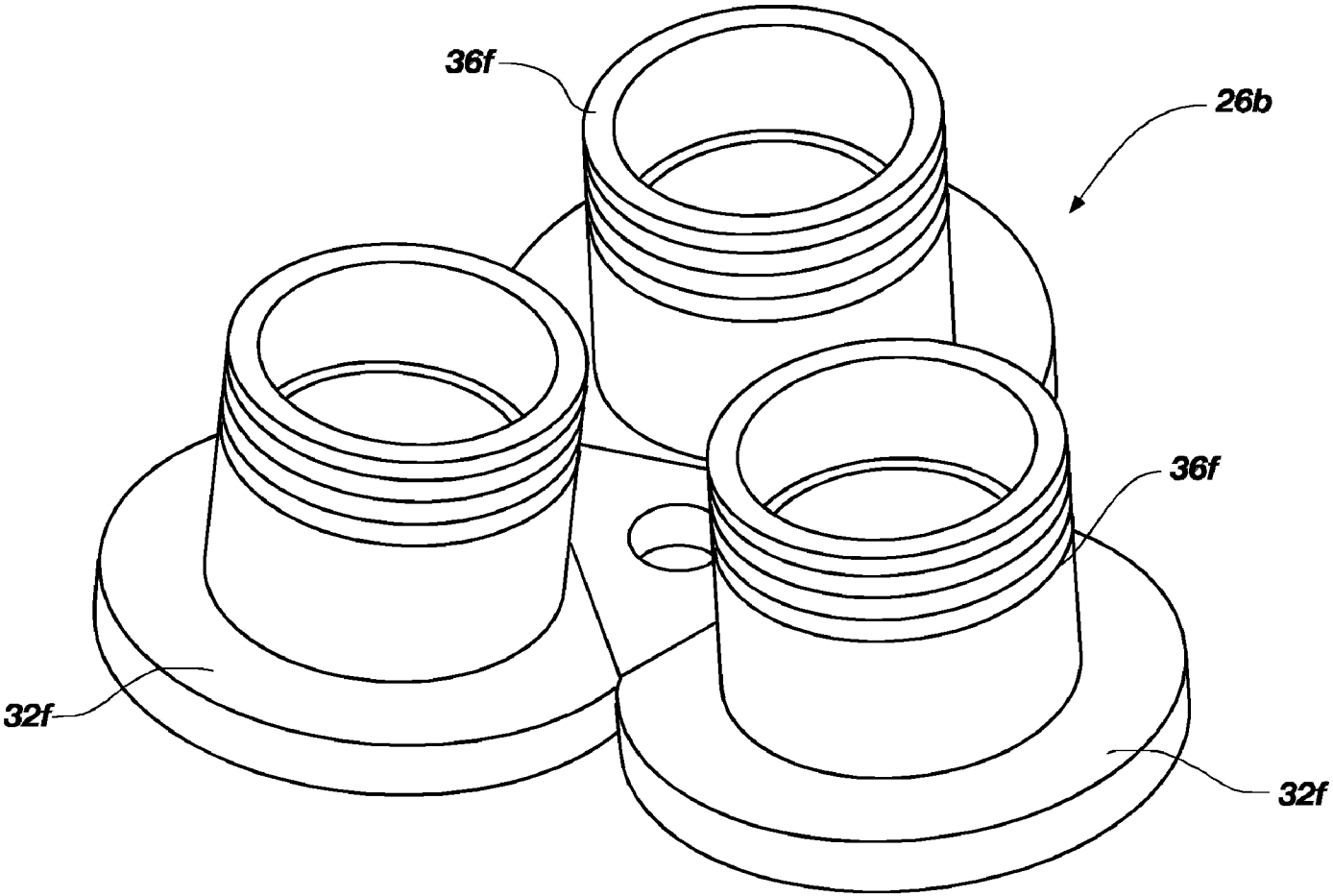
FIG. 10 is a perspective view of an additional alternative embodiment roof bolt plate.

Reference will now to made to FIG. 10 to describe an additional alternative embodiment of the present disclosure. As previously discussed, the presently disclosed embodiments of the disclosure illustrated herein are merely exemplary of the possible embodiments of the disclosure, including that illustrated in FIG. 10.

It will be appreciated that the alternative embodiment of the disclosure illustrated in FIG. 10 contains many of the same structures represented in FIGS. 1-9 and only the new or different structures will be explained to most succinctly explain the features which come with the embodiments of the disclosure illustrated in FIG. 10.

Figure 11:
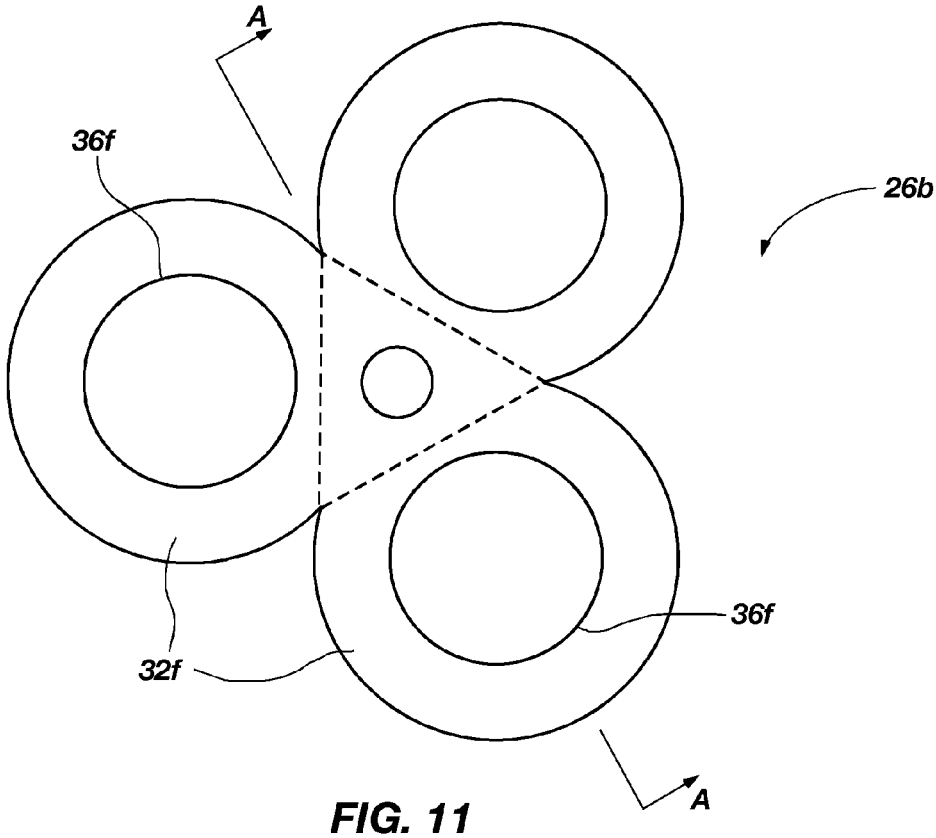
FIG. 11 is a plan view of the roof bolt plate of FIG. 10.
Figure 12:
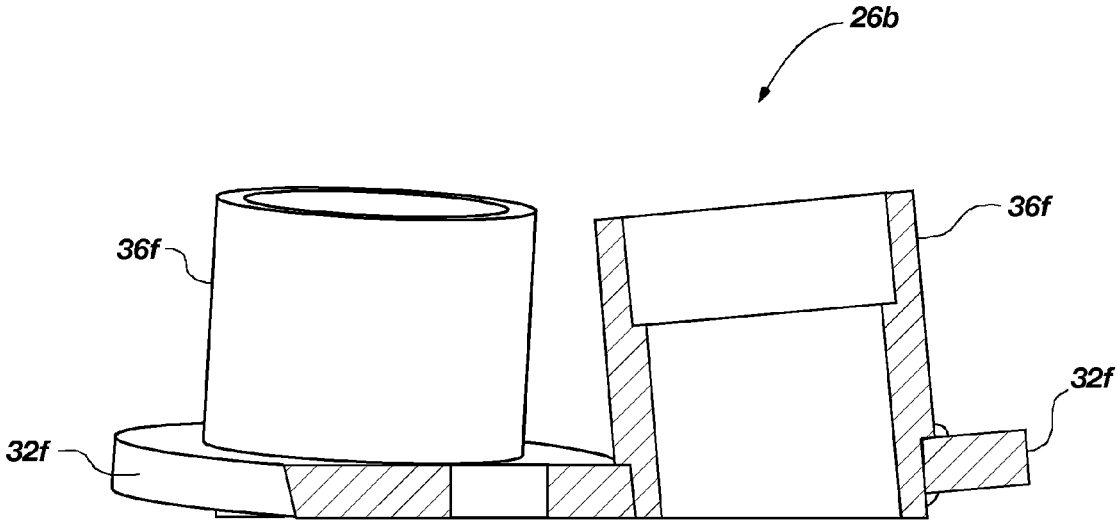
FIG. 12 is a side, cross-sectional view of the roof bolt plate of FIG. 11, taken along line A-A.

FIG. 10 shows a perspective view of an alternative embodiment support member, indicated generally at 26*b*. The support member 26*b* may be formed in a substantial triangular configuration having three extensions 32*f* and three sockets 36*f*. It will be understood that a plan view of the support member 26*b* is shown in FIG. 11, and a side cross-sectional view of the support member 26*b*, taken along line A-A in FIG. 11, is shown in FIG. 12.

Figure 13:
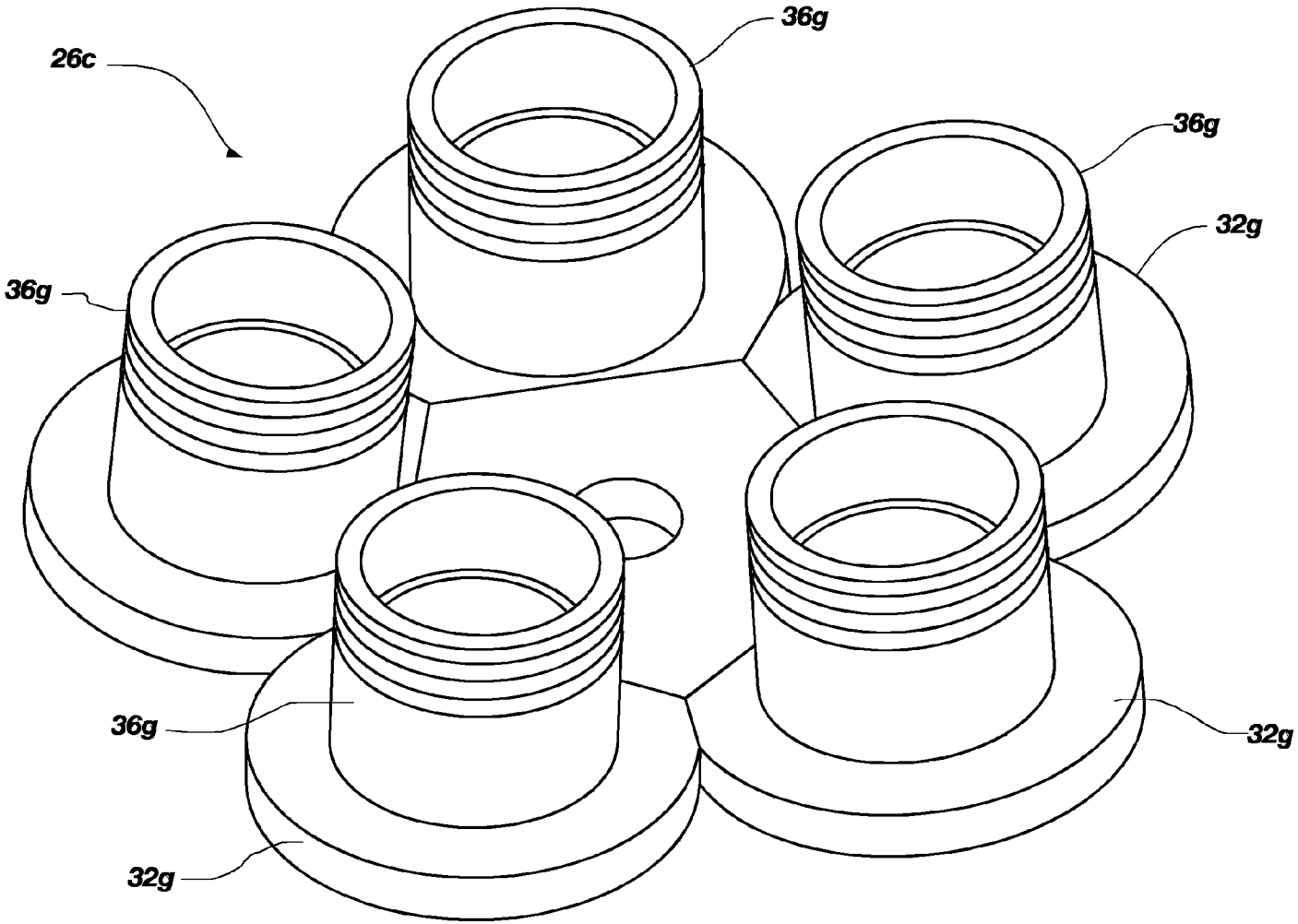
FIG. 13 is a perspective view of another alternative embodiment roof bolt plate.
Figure 14:
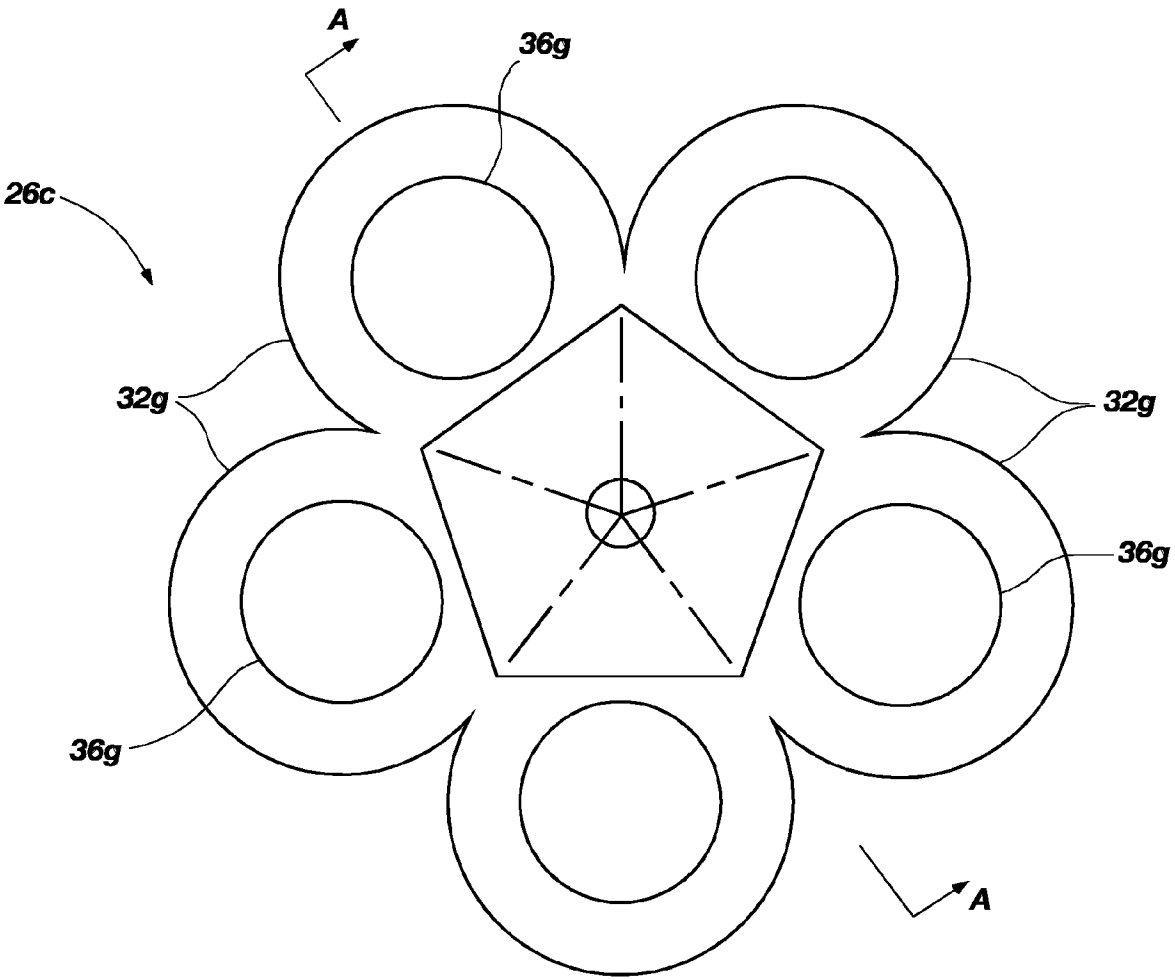
FIG. 14 is a plan view of the roof bolt plate of FIG. 13.
Figure 15:
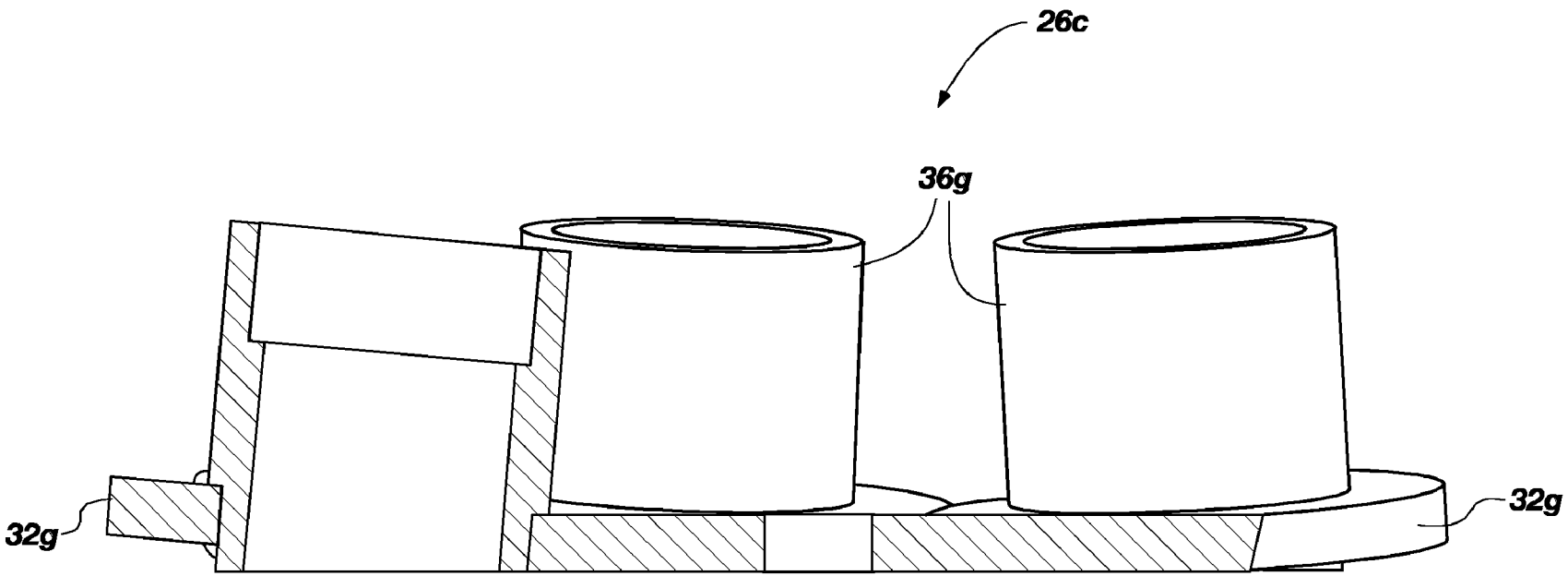
FIG. 15 is a side, cross-sectional view of the roof bolt plate of FIG. 14, taken along line A-A.

Similarly, referring to FIGS. 13-15, another alternative embodiment support member 26*c* is shown. It will be appreciated that the alternative embodiment of the disclosure illustrated in FIGS. 13-15 contains many of the same structures represented in FIGS. 1-12 and only the new or different structures will be explained to most succinctly explain the features which come with the embodiments of the disclosure illustrated in FIGS. 13-15.

The support member 26*c* may be formed having five extensions 32*g* and five sockets 36*g*. It will be understood that a perspective view of the support member 26*c* is shown in FIG. 13, whereas a plan view of the support member 26*c* is shown in FIG. 14, and a side cross-sectional view of the support member 26*c*, taken along line A-A in FIG. 14, is shown in FIG. 15.

Figure 16:
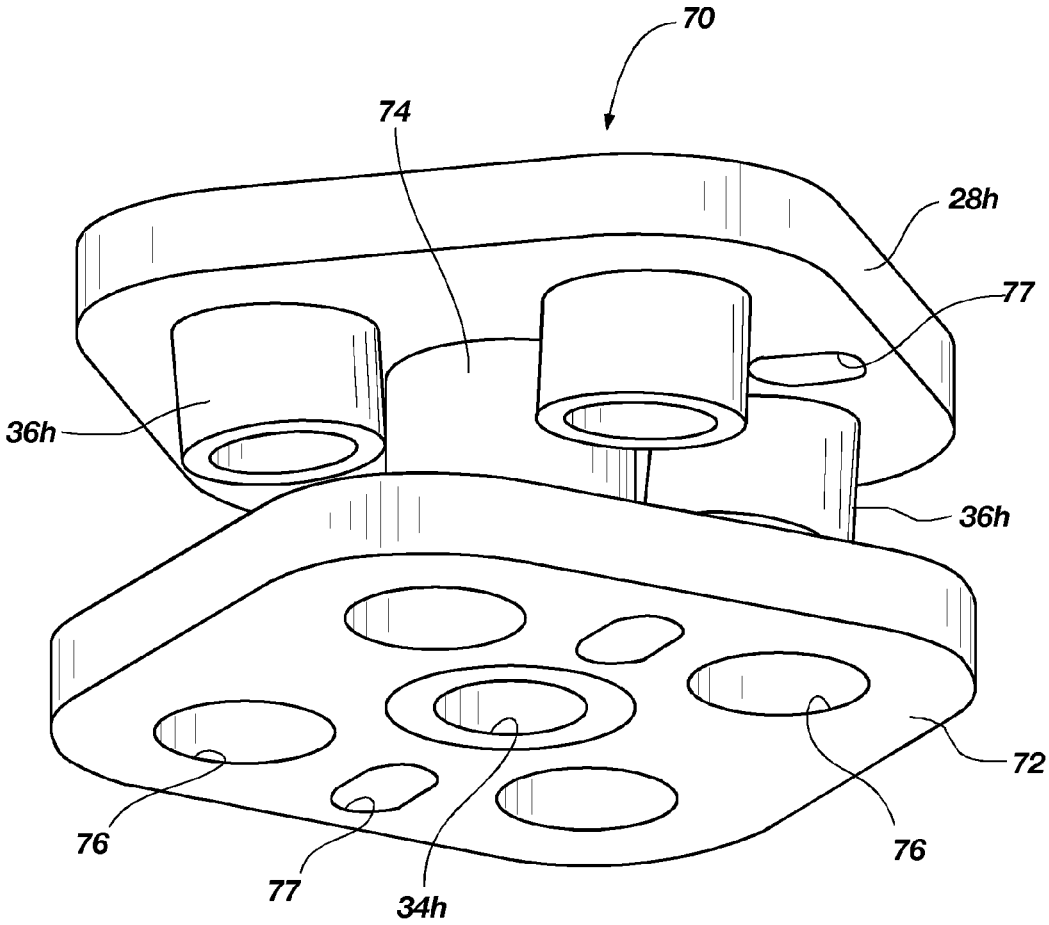
FIG. 16 is a perspective view of an additional alternative embodiment roof bolt plate.

Reference will now to made to FIG. 16 to describe an additional alternative embodiment of the present disclosure. As previously discussed, the presently disclosed embodiments of the disclosure illustrated herein are merely exemplary of the possible embodiments of the disclosure, including that illustrated in FIG. 16.

It will be appreciated that the alternative embodiment of the disclosure illustrated in FIG. 16 contains many of the same structures represented in FIGS. 1-15 and only the new or different structures will be explained to most succinctly explain the features which come with the embodiments of the disclosure illustrated in FIG. 16.

FIG. 16 shows a perspective view of an alternative embodiment support member, indicated generally at 70. The support member 70 may include a base 28*h* having sockets 36*h* and a rotatable cover 72 supported on a post 74. Once the roof bolts 18 have been installed, the cover 72 may be rotated about the post 74, as best shown in the plan view of the support member 70 shown in FIG. 17, such that the cover openings 76 are not in alignment with the sockets 36*h* to thereby block the roof bolts 18 from exiting the sockets 36*h*.

One embodiment of the support member 70 may also include slots 77 for receiving fasteners or bolts (not shown) for attaching the support member 70 to the ceiling 14 to hold the support member 70 in place while the roof bolts 18 are installed. The slots 77 may function similar to the fastener opening 34 in previously disclosed embodiments. It will be understood that the fasteners used in the slots 77 to attach the support member 70 to the ceiling 14 may have any suitable size, such as two feet in length, for example. In some embodiments, the fasteners in the slots 77 may be used as a temporary holding mechanism to hold the support member 70 to the ceiling 14 until the roof bolts 18 are installed, whereas in other embodiments, the fasteners in the slots 77 may be left in place in the ceiling 14 permanently. It will be understood, however, that the quantity, size, configuration and position of the slots 77 may vary as desired within the scope of the present disclosure. Accordingly, some embodiments may include slots 77 in only the base 28*h*, and other embodiments may have more slots 77 in the base than in the rotatable cover 72, or more slots in the rotatable cover 72 than in the base 28*h*.

Figure 17:
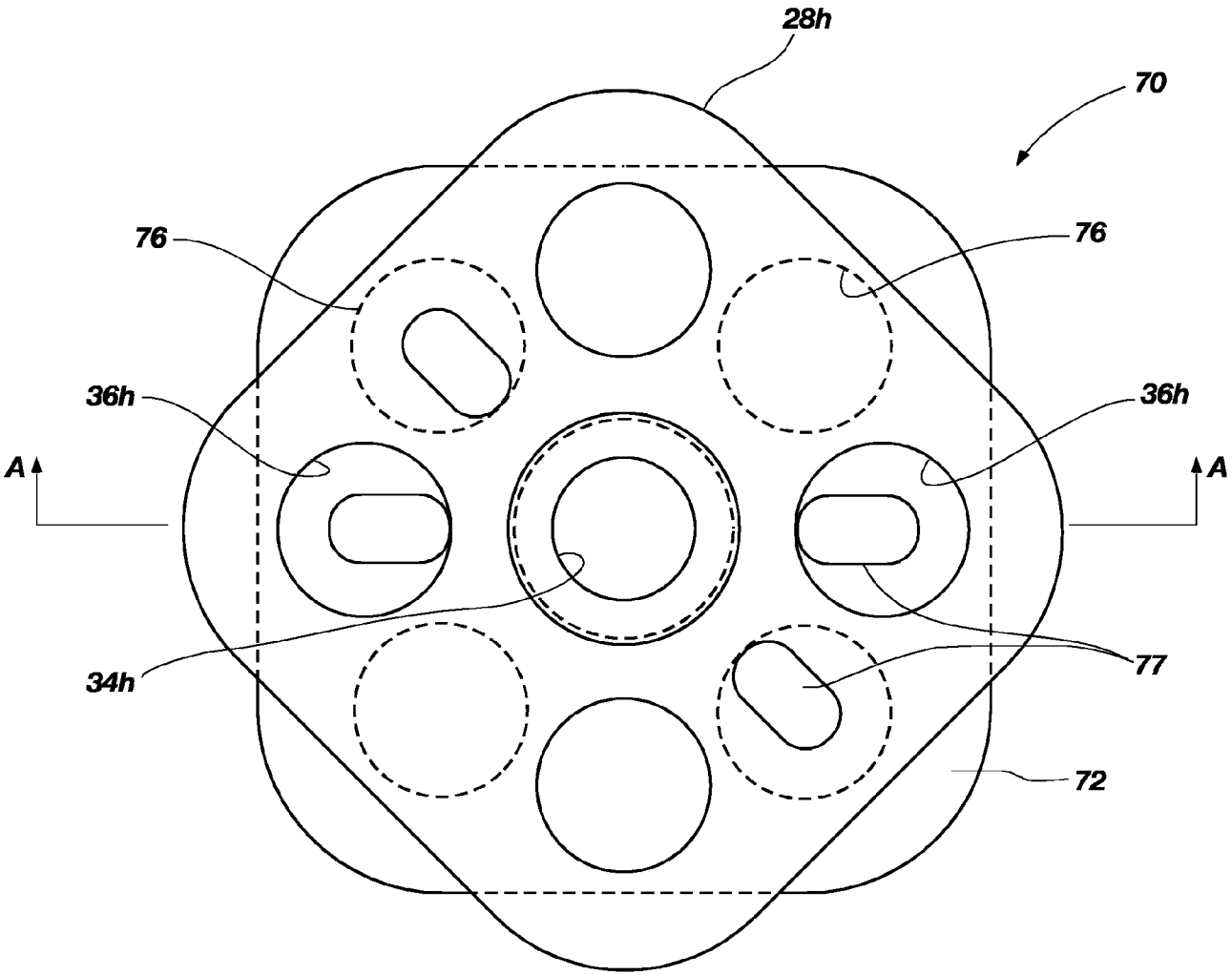
FIG. 17 is a plan view of the embodiment of the roof bolt plate of FIG. 16.
Figure 18:
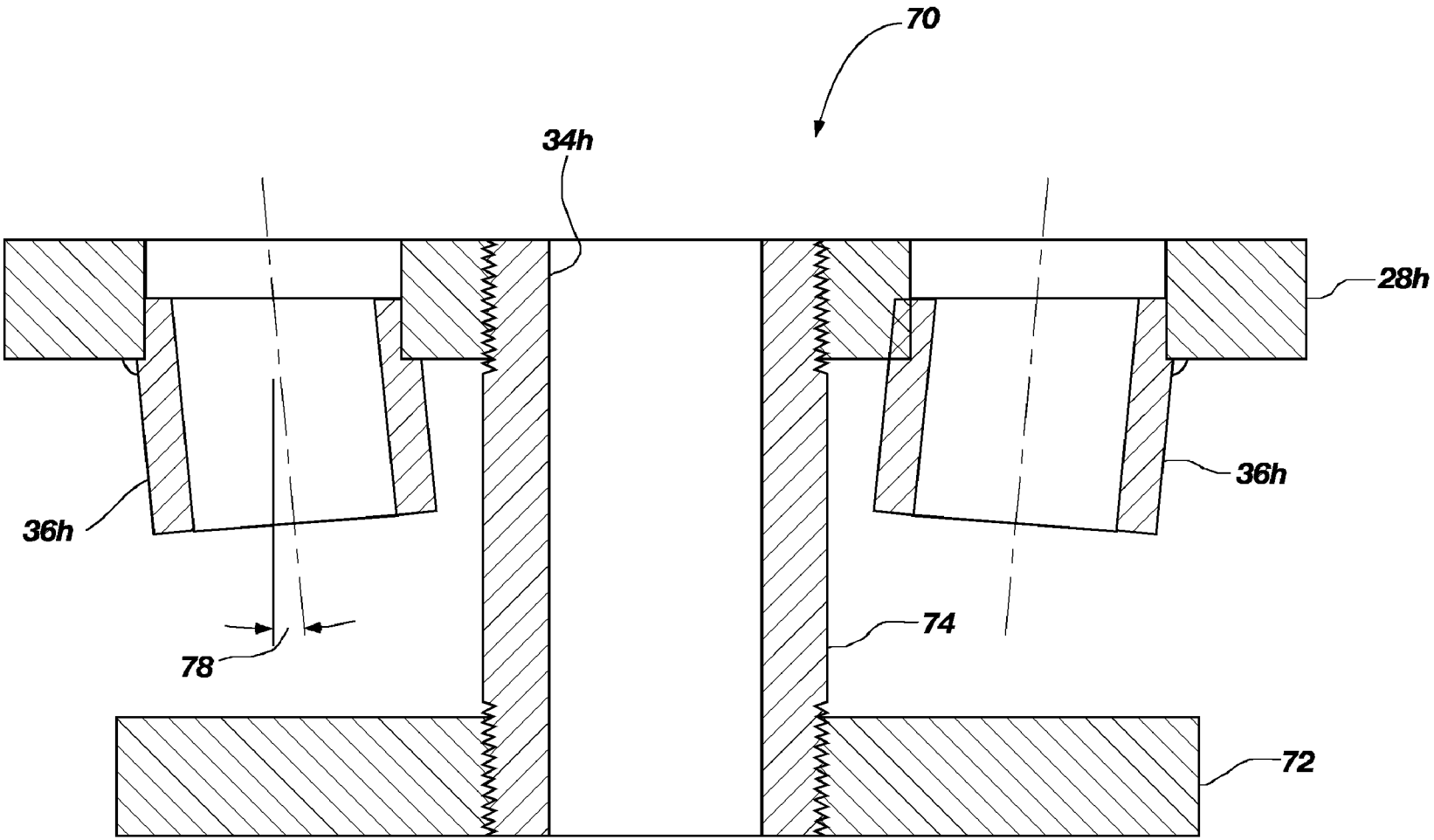
FIG. 18 is a side, cross-sectional view of the roof bolt plate of FIG. 17, taken along line A-A.

As shown most clearly in FIG. 18, which shows a side cross-sectional view of the support member 70 taken along line A-A in FIG. 17, the base 28*h* and the cover 72 may be threadably attached to the post 74 so as to rotate with respect to the post 74. It will be understood that the base 28*h* or the cover 72 may also be fixed to the post 74 in other embodiments. The post 74 may define a fastener opening 34*h* for receiving a fastener (not shown) for fastening the support member 70 to the ceiling 14 of the tunnel 10, in a manner similar to the previously disclosed embodiments. Also, the base 28*h* may be positioned substantially parallel to the cover 72, and the sockets 36*h* may be disposed at a non-perpendicular angle with respect to the base 28*h*, as indicated at 78. One embodiment of the present disclosure may include the sockets 36*h* disposed at an angle 78 of approximately 5 degrees, for example, such that the sockets 36*h* may extend at an angle of approximately 85 degrees with respect to the base 28*h*. However, it will be understood that the sockets 36*h* may be disposed at other suitable angles within the scope of the present disclosure.

Figure 19:
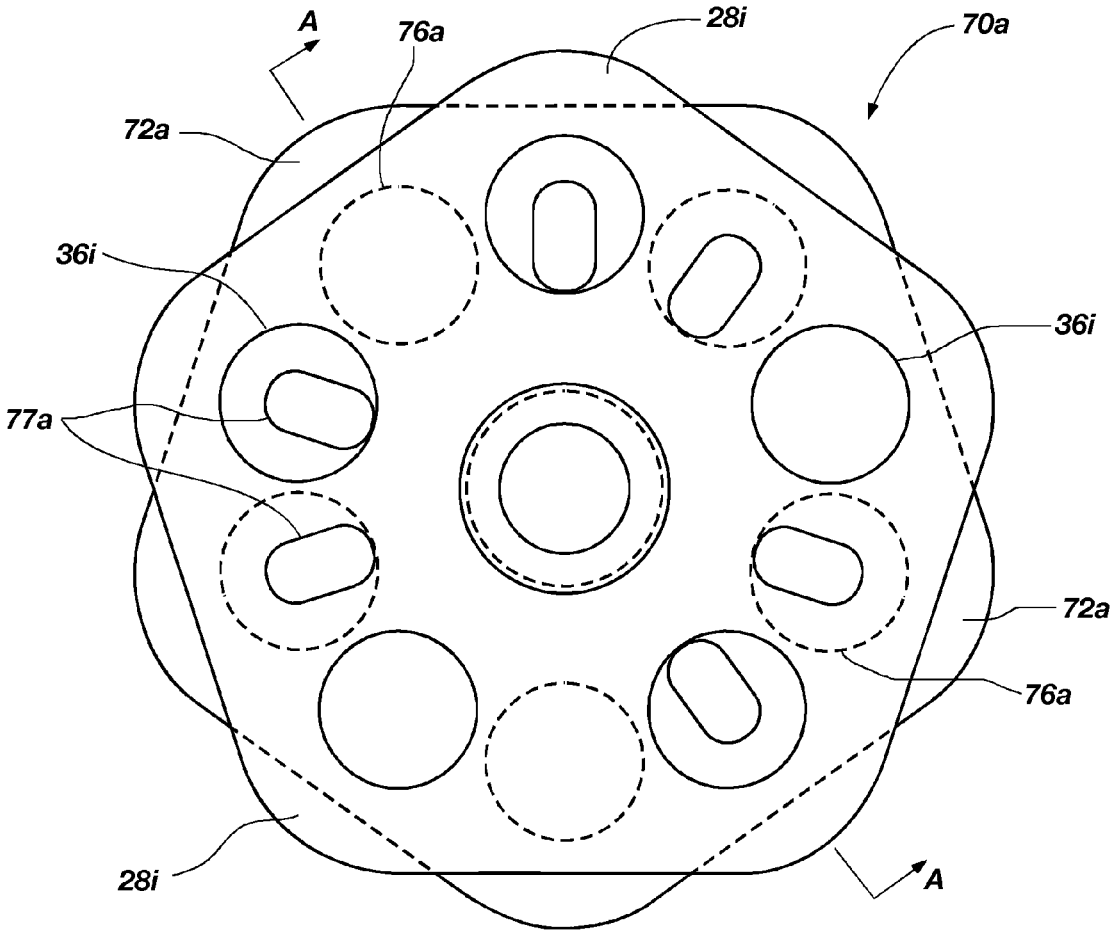
FIG. 19 is a plan view of an additional alternative embodiment roof bolt plate.

Another alternative embodiment of the present disclosure is shown in FIG. 19, which shows a plan view of a support member 70*a*. The support member 70*a* may be configured similar to the embodiment of the disclosure depicted in FIGS. 16-18, except that the support member 70*a* may include five openings 76*a* and five sockets 36*i*. Moreover, the base 28*i* and the cover 72*a* may each have a substantial pentagonal shape.

Figure 20:
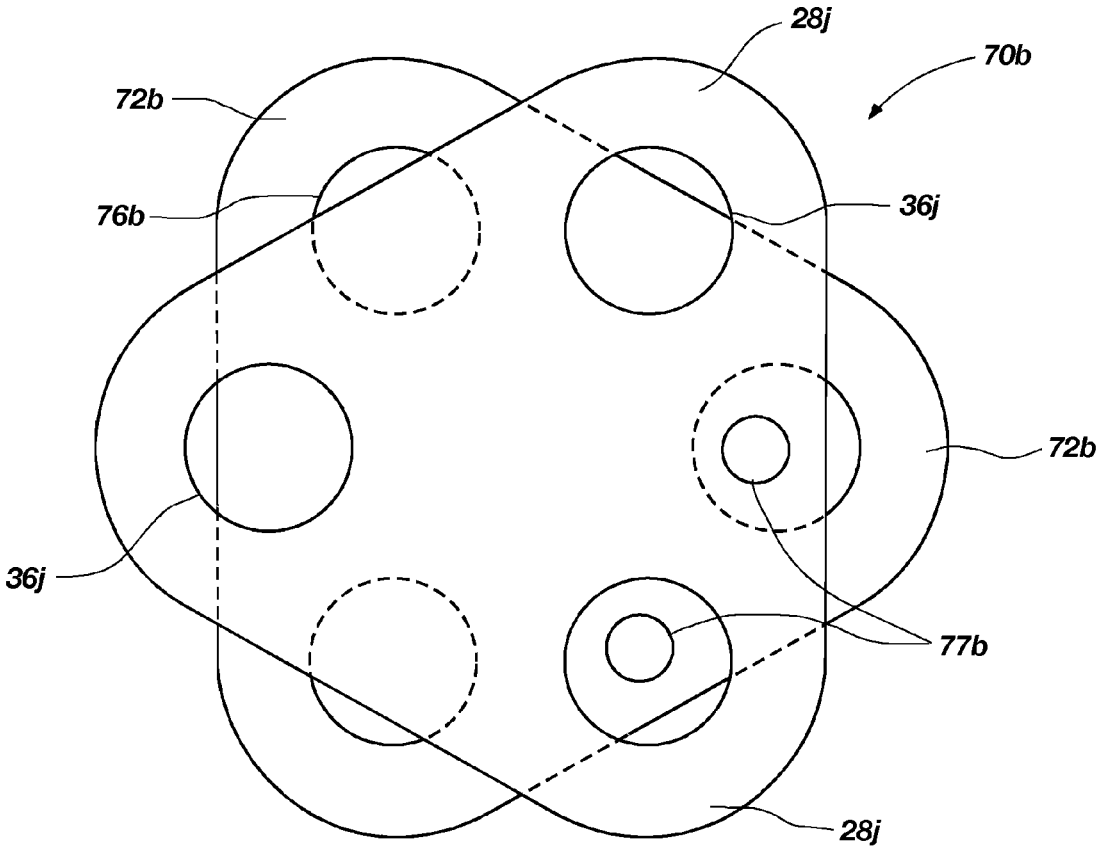
FIG. 20 is a plan view of an additional alternative embodiment roof bolt plate.

It will also be understood that a support member 70*b* may be formed in various other shapes and configurations within the scope of the present disclosure, such as a substantially triangular shape base 28*j* and cover 72*b*, as shown in the plan view of the alternative embodiment of the disclosure depicted in FIG. 20. The support member 70*b* may thus include three openings 76*b* and three sockets 36*j*. It will be understood, however, that the support member may be formed in various other shapes and the support member may have different numbers of openings and sockets within the scope of the present disclosure.

Figure 21:
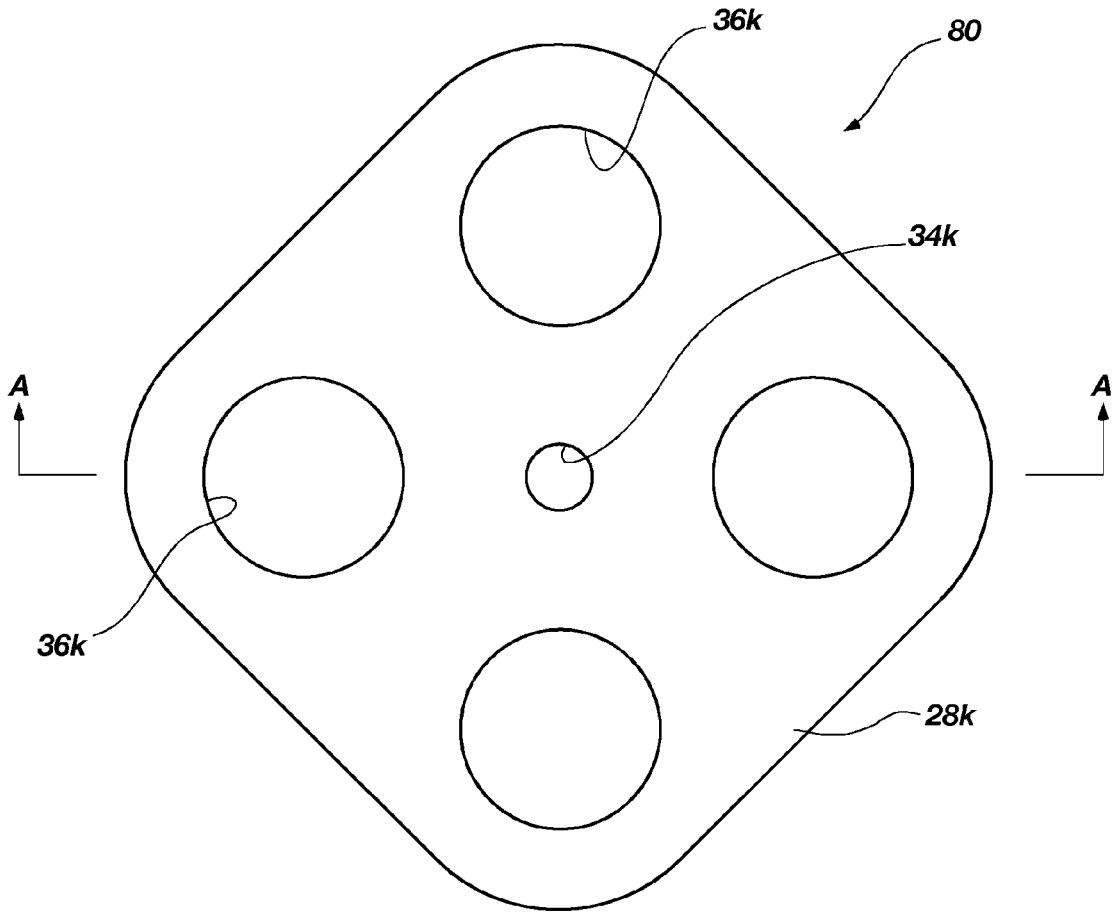
FIG. 21 is a plan view of a further alternative embodiment roof bolt plate.
Figure 22:
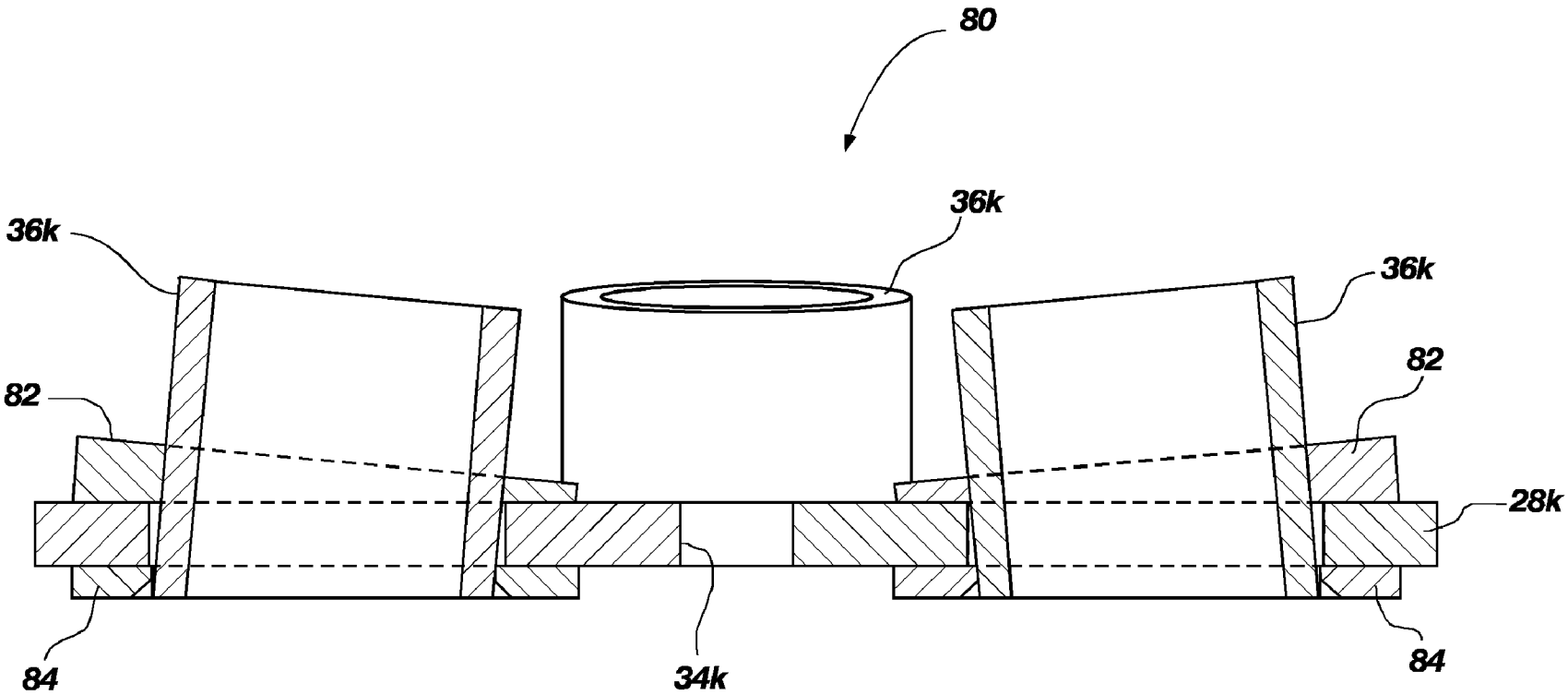
FIG. 22 is a side, cross-sectional view of the roof bolt plate of FIG. 21, taken along line A-A.

Reference will now to made to FIGS. 21 and 22 to describe another alternative embodiment of the present disclosure. As previously discussed, the presently disclosed embodiments of the disclosure illustrated herein are merely exemplary of the possible embodiments of the disclosure, including that illustrated in FIGS. 21 and 22.

It will be appreciated that the alternative embodiment of the disclosure illustrated in FIGS. 21 and 22 contains many of the same structures represented in FIGS. 1-20 and only the new or different structures will be explained to most succinctly explain the features which come with the embodiments of the disclosure illustrated in FIGS. 21 and 22.

FIG. 21 shows a plan view of another embodiment of a support member, indicated generally at 80. The support member 80 may include a base 28*k* that may be somewhat square shaped. It will also be understood that the support member 80 may be formed in various different shapes within the scope of the present disclosure. The support member 80 may include sockets 36*k* and a fastener opening 34*k*. As shown in FIG. 22, which shows a side, cross-sectional view of the support member 80 taken along line A-A in FIG. 21, the base 28*k* may be substantially planar. Sockets 36*k* may be disposed on the base 28*k* at an angle, such as approximately 5 degrees from perpendicular to the base 28*k*, for example. Tapered washers 82 may be attached to the base 28*k* surrounding the sockets 36*k* to provide support to the sockets 36*k* on the base 28*k*. Washers 84 may also be attached to the base 28*k* on an opposite side of the base 28*k* as the tapered washers 82. It will be understood that the tapered washers 82 and the washers 84 may be welded to the sockets 36*k* and the base 28*k*, or the tapered washers 82 and the washers 84 may be joined to the base 28*k* and/or sockets 36*k* in any other suitable manner known to those skilled in the art. It will be understood that the tapered washer 82 and washer 84 may be utilized to support the sockets 36*k* on the base 28*k* in a stable manner even though the sockets 36*k* may be disposed at an angle with respect to the base 28*k*.

Figure 23:
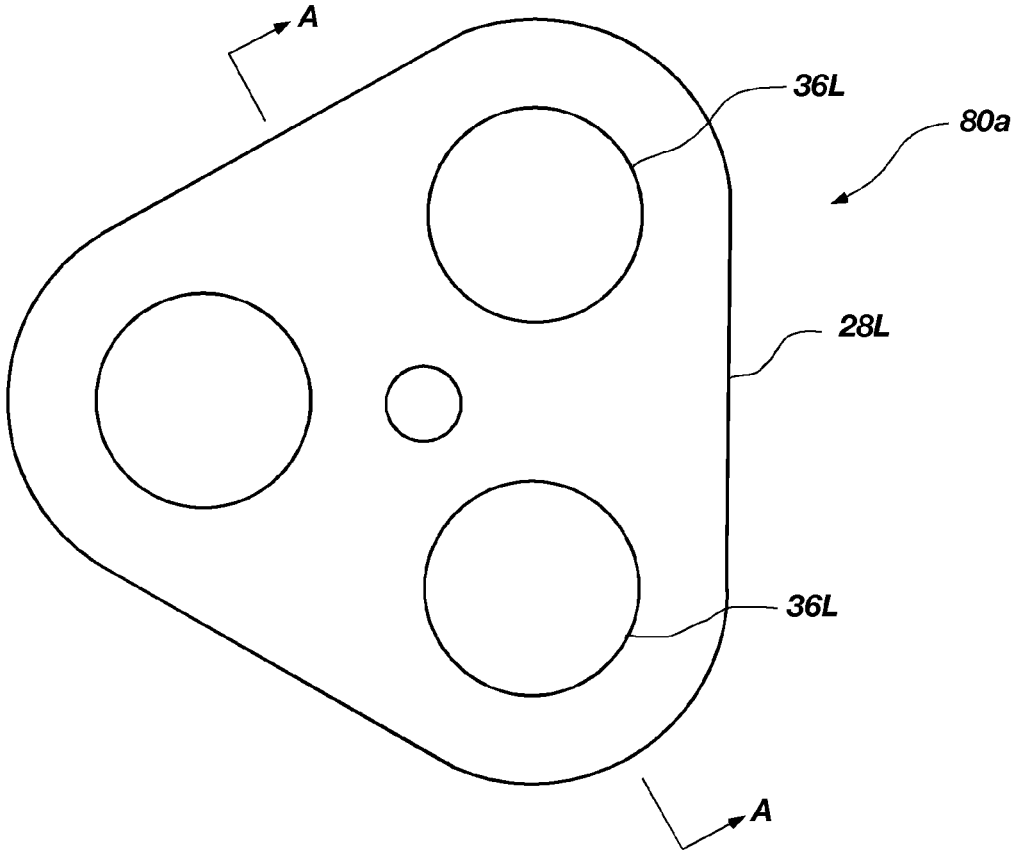
FIG. 23 is a plan view of another alternative embodiment roof bolt plate.
Figure 24:
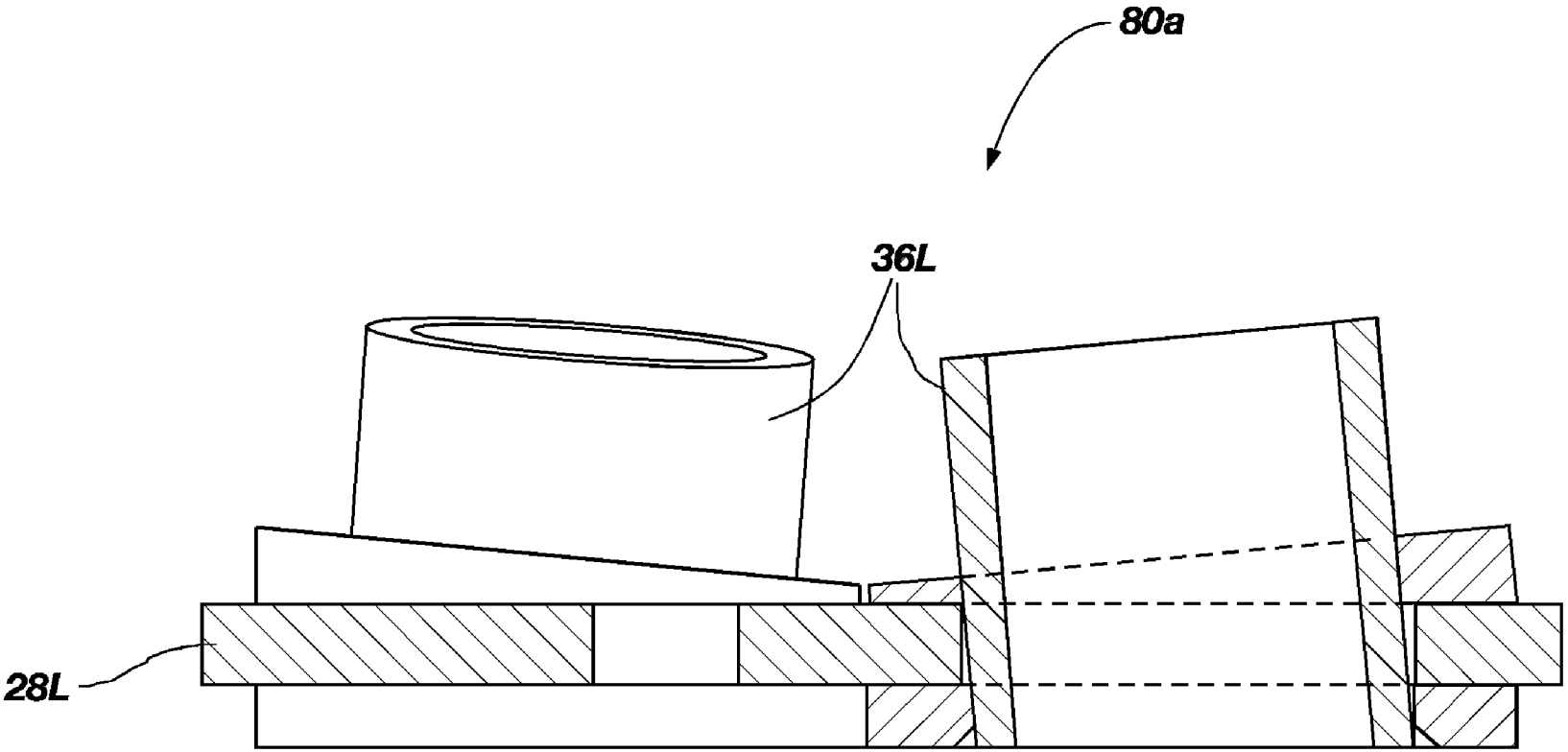
FIG. 24 is a side, cross-sectional view of the roof bolt plate of FIG. 23, taken along line A-A.

It will also be understood that an additional embodiment of the support member 80*a*, as shown in FIGS. 23 and 24, may be provided having three sockets 36*l*. FIG. 23 depicts a plan view of the support member 80*a*, whereas FIG. 24 depicts a side, cross-sectional view of the support member 80*a*, taken along line A-A of FIG. 23. The support member 80*a* may include a base 28*l* that forms a substantially triangular member.

Figure 25:
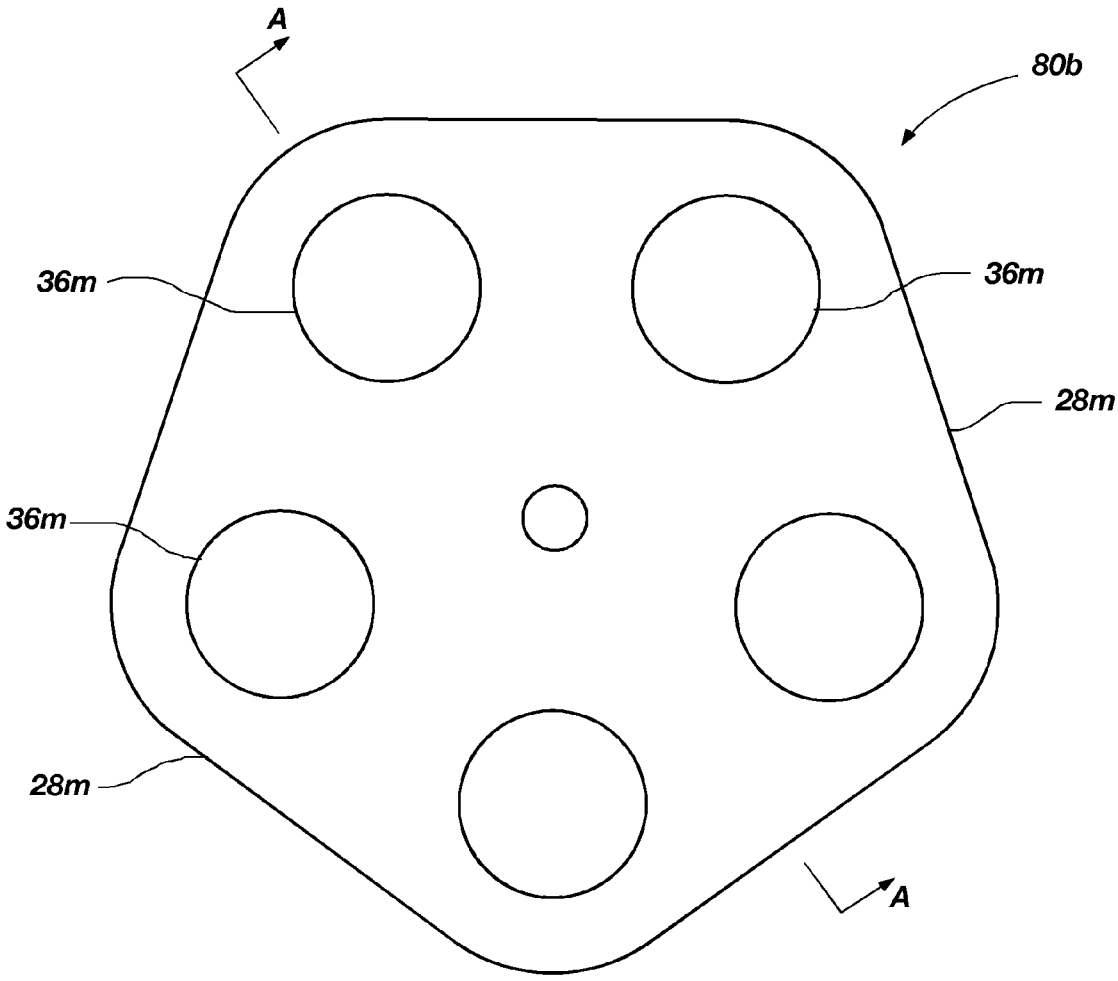
FIG. 25 is a plan view of an additional alternative embodiment roof bolt plate.
Figure 26:
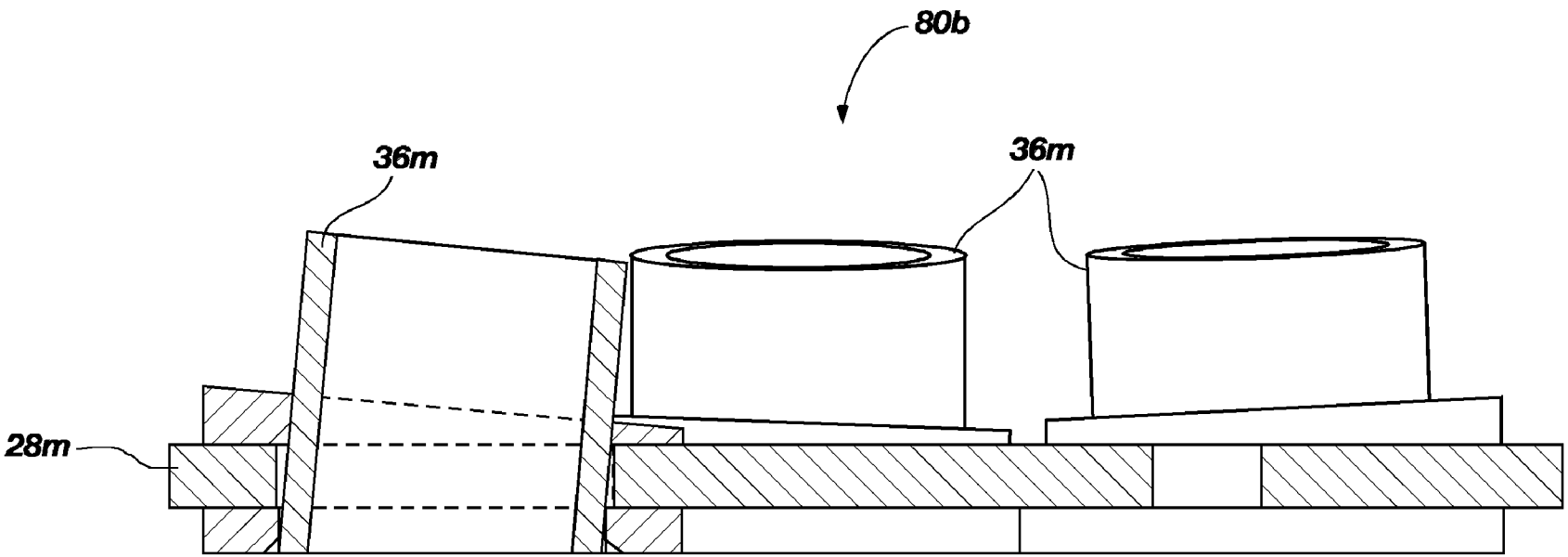
FIG. 26 is a side, cross-sectional view of the roof bolt plate of FIG. 25, taken along line A-A.

Moreover, another alternative embodiment of the support member 80*b*, as shown in FIGS. 25 and 26, may be provided having five sockets 36*m*. FIG. 25 depicts a plan view of the support member 80*b*, whereas FIG. 26 depicts a side, cross-sectional view of the support member 80*b*, taken along line A-A of FIG. 25. The support member 80*b* may include a base 28*m* that may form a substantially pentagonal member. However, as previously discussed, it will be understood that the support member may be formed in various different configurations.

Figure 27:
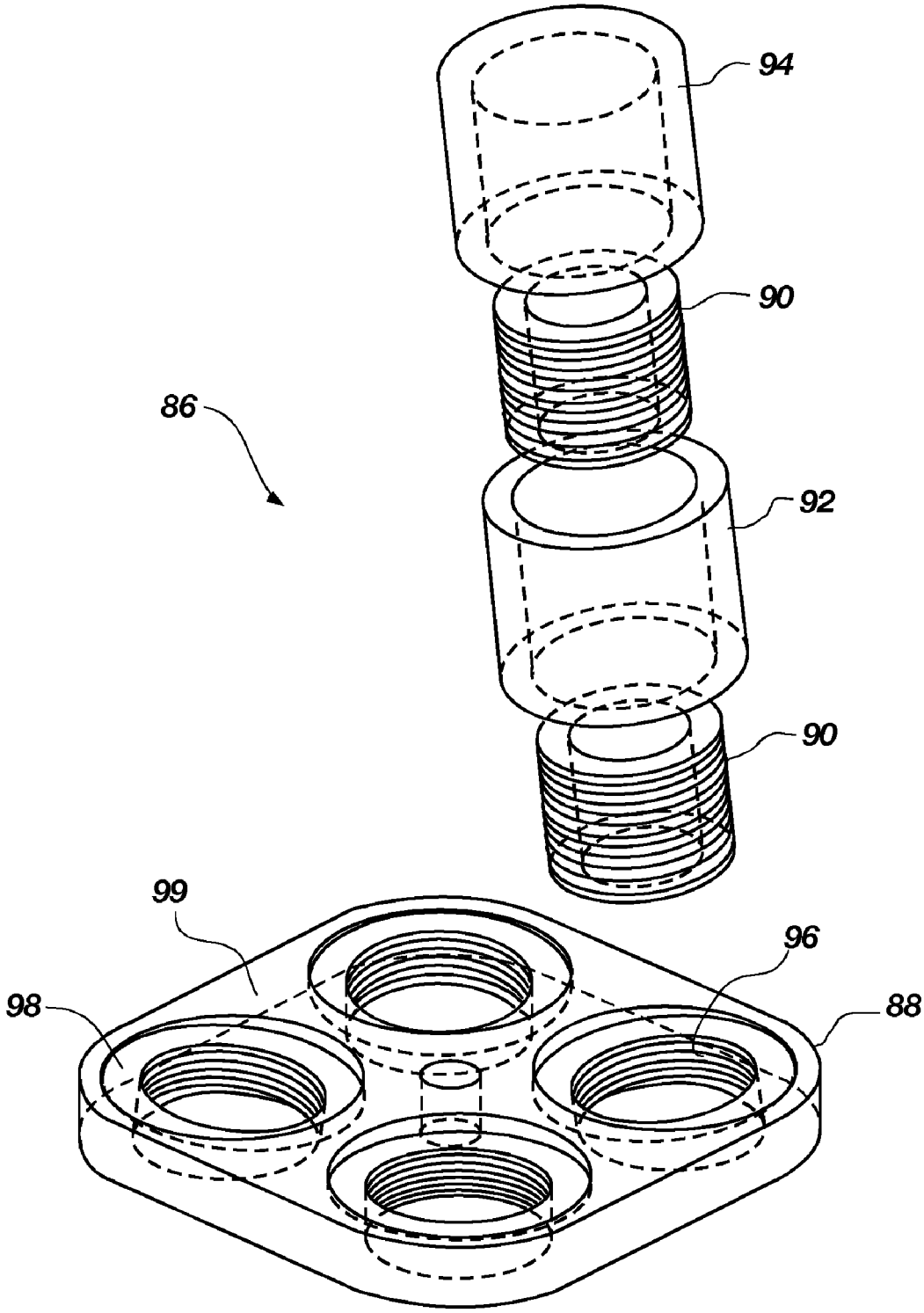
FIG. 27 is an exploded perspective view of an additional alternative embodiment roof bolt plate.
Figure 28:
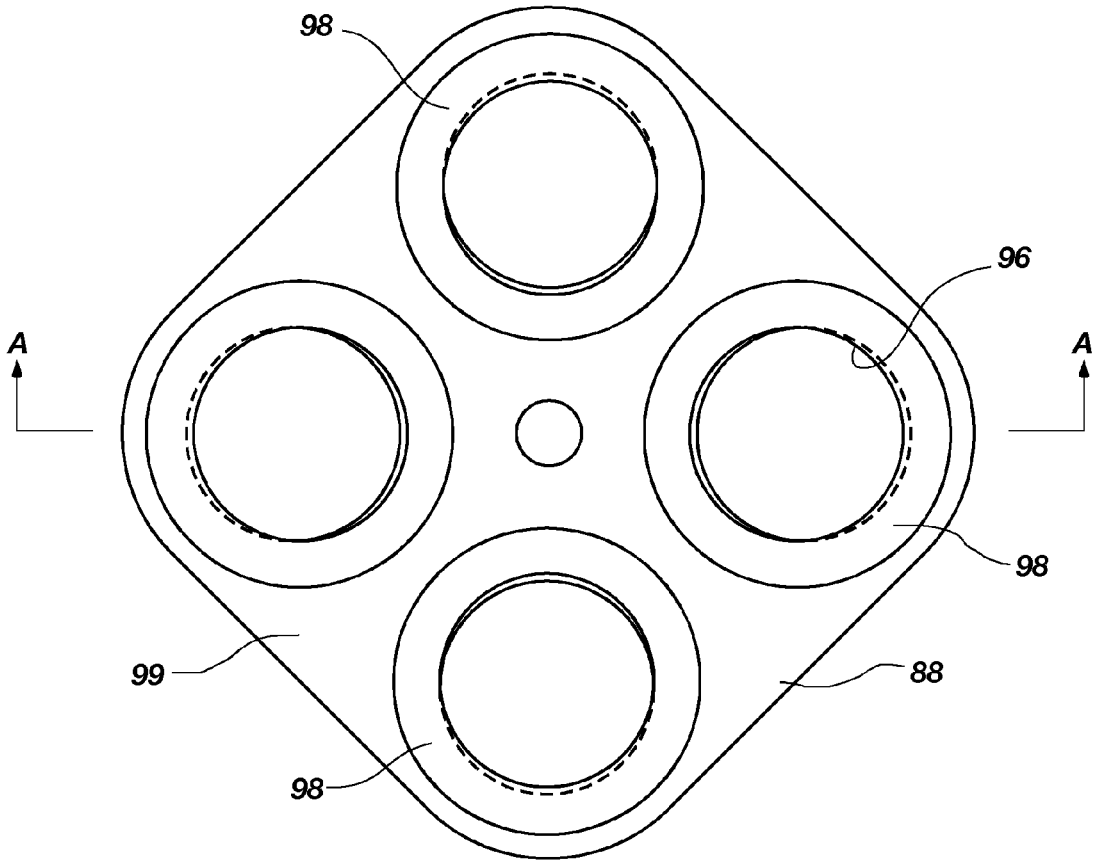
FIG. 28 is a plan view of the roof bolt plate of FIG. 27.
Figure 29:
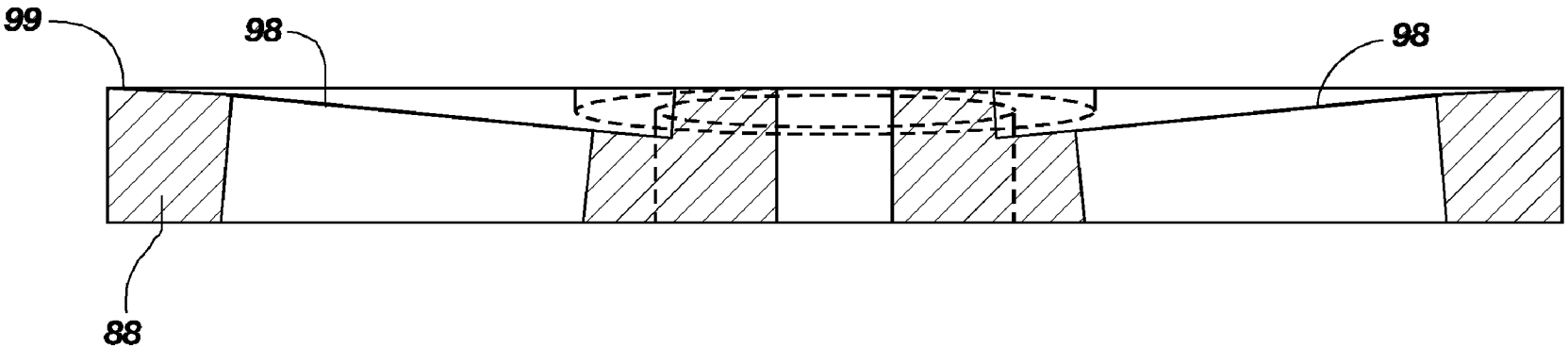
FIG. 29 is a side, cross-sectional view of the roof bolt plate of FIG. 28, taken along line A-A.

Reference will now to made to FIGS. 27-29 to describe an additional alternative embodiment of the present disclosure. As previously discussed, the presently disclosed embodiments of the disclosure illustrated herein are merely exemplary of the possible embodiments of the disclosure, including that illustrated in FIGS. 27-29.

It will be appreciated that the alternative embodiment of the disclosure illustrated in FIGS. 27-29 contains many of the same structures represented in FIGS. 1-26 and only the new or different structures will be explained to most succinctly explain the features which come with the embodiments of the disclosure illustrated in FIGS. 27-29.

FIG. 27 shows an exploded perspective view of another alternative embodiment support member, indicated generally at 86. The support member 86 may include a base 88, one or more connectors 90, a socket 92, and a cover 94. The base 88 may include an opening 96 that may be threaded for engaging with a connector 90, that may also be threaded on an exterior surface. It will be understood that other attachment mechanisms may be used to attach the connector 90 to the base 88 within the scope of the present disclosure. The connector 90 may also threadably engage with the socket 92 for attaching the socket 92 to the base 88. Accordingly, an interior of the socket 92 may also be threaded. Another connector 90 may be joined with the socket 92 and the cover 94 may be joined with the connector 90, such as by threaded engagement, to enclose the socket 92. It will be understood that some embodiments of the present disclosure may include components, such as the connectors 90, sockets 92 and/or cover 94, that may be obtained in the form of standard pipe equipment or fittings that may be commercially available, whereas in other embodiments, such components may be custom made as part of the support member 86.

A plan view of the support member 86 is shown in FIG. 28, and a side cross-sectional view of the support member 86, taken along line A-A in FIG. 28, is shown in FIG. 29. As shown most clearly in FIG. 29, the base 88 may have an inclined surface 98 circumscribing each of the openings 96 for receiving the socket 92. The openings 96 may project substantially perpendicularly with respect to the inclined surface 98 such that the openings 96 may project at non-perpendicular angles with respect to a surface 99 of the support member 86. Accordingly the openings 96 may project at angles converging toward each other to enable the roof bolts 18 to be installed through the openings 96 in a splayed configuration. It will be understood that the inclined surface 98 may extend at a 5 degree angle, or any other suitable angle, with respect to the surface 99 of the support member 86.

Figure 30:
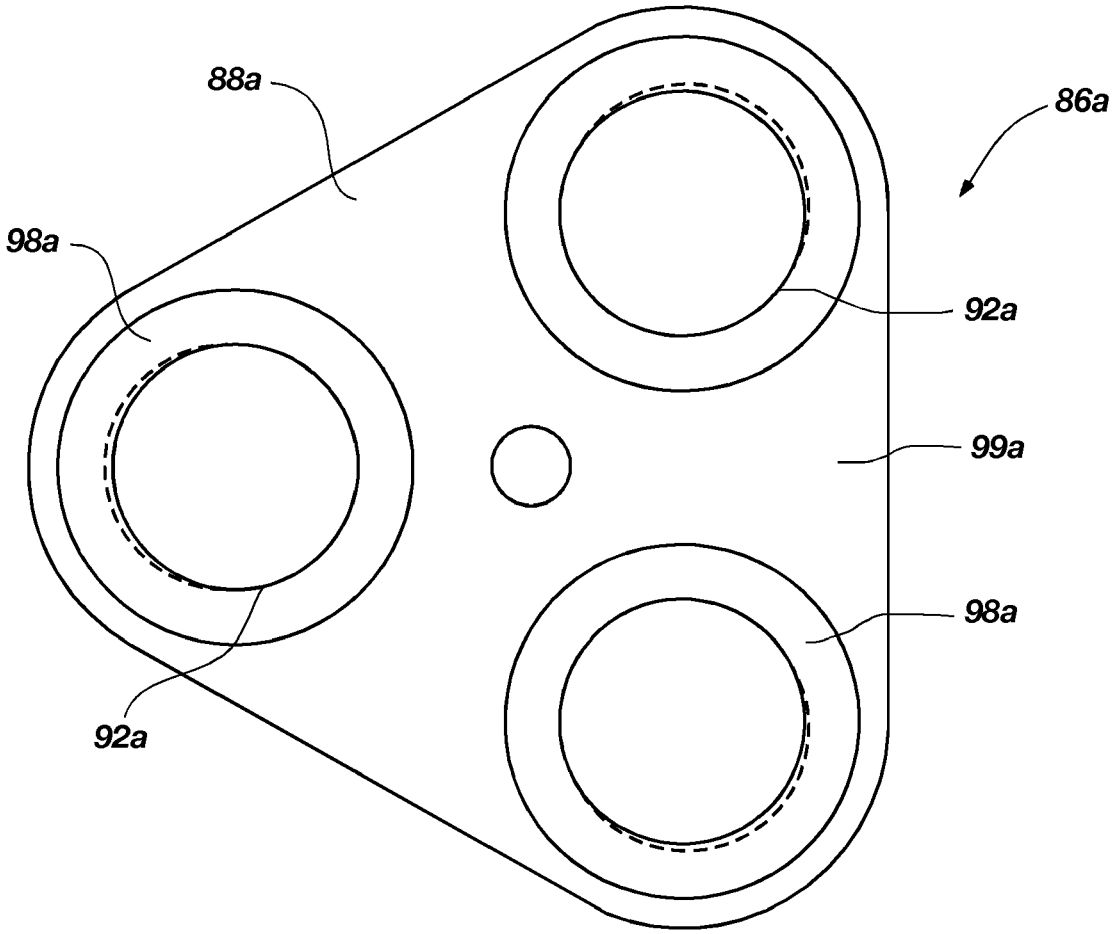
FIG. 30 is a plan view of an additional alternative embodiment roof bolt plate.
Figure 31:
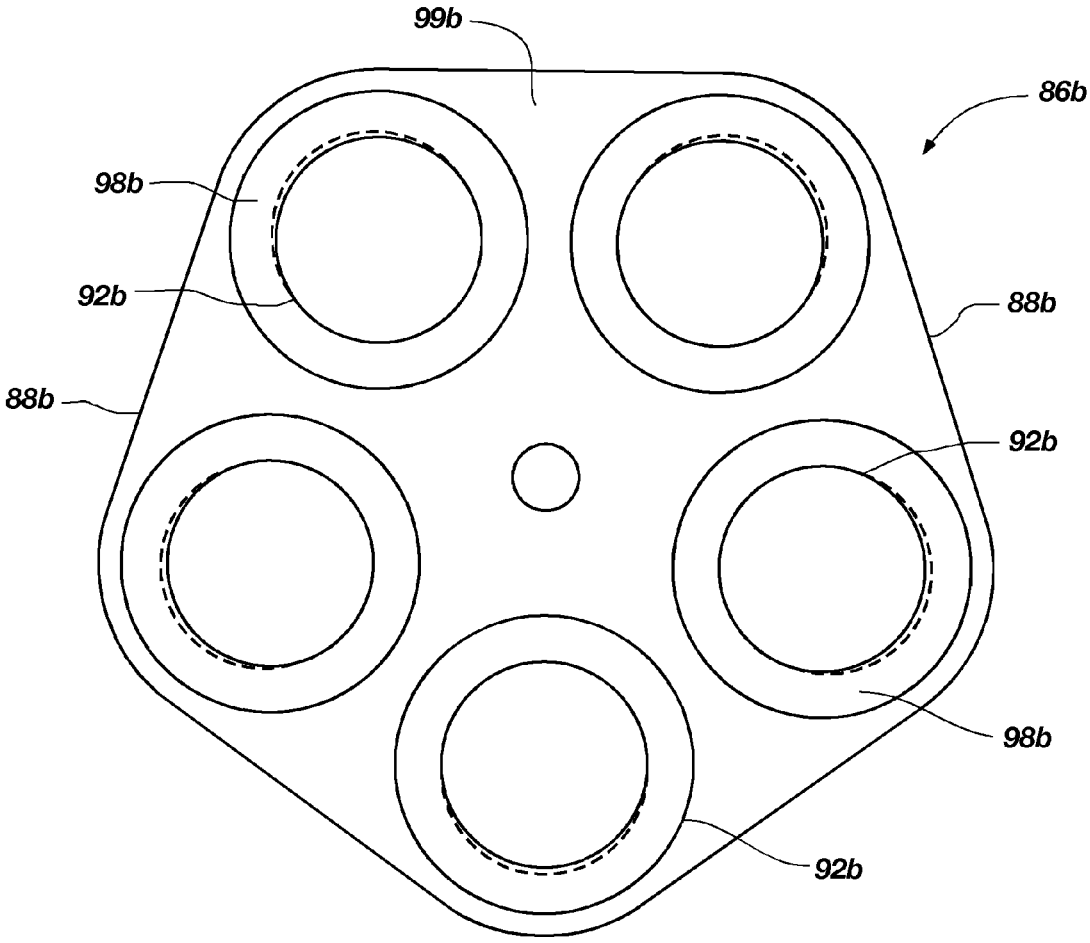
FIG. 31 is a plan view of another alternative embodiment roof bolt plate.

As shown in FIG. 30, which shows a plan view of an alternative embodiment support member 86*a*, the support member 86*a* may have a base 88*a* in different configurations for accommodating different numbers of sockets 92*a* and inclined surfaces 98*a*. For example, the support member 86*a* may be configured to have three sockets 92*a*. Moreover, as shown in FIG. 31, which shows a plan view of an additional alternative embodiment support member 86*b*, the support member 86*b* may be configured to include any other quantity of sockets 92*b*, such as five for example.

Figure 32:
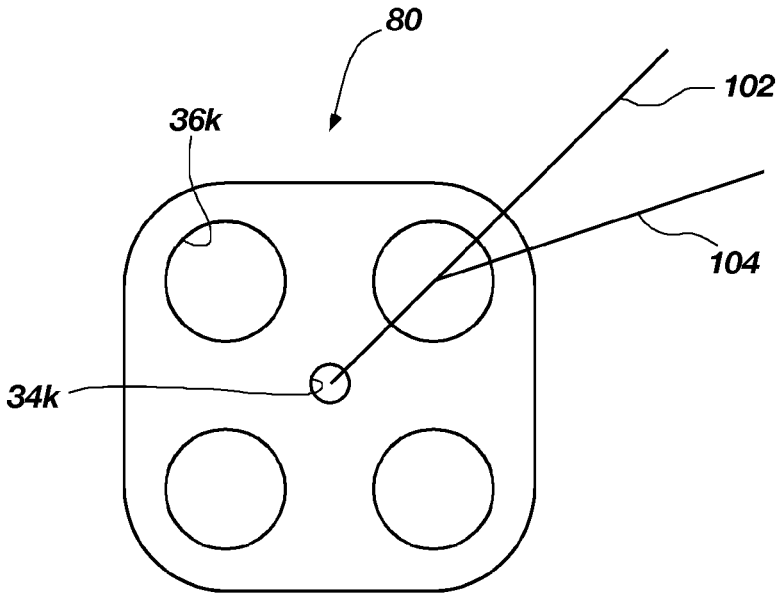
FIG. 32 is a plan view of an alternative embodiment roof bolt plate showing exemplary directions that roof bolts may extend.
Figure 33:
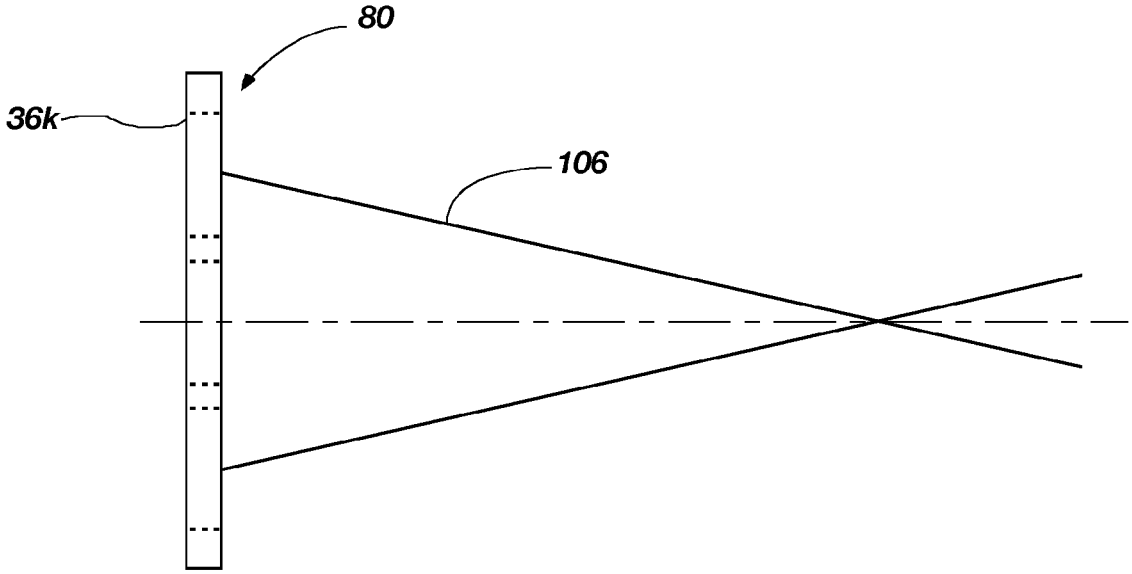
FIG. 33 is a side view of another embodiment roof bolt plate configured to receive roof bolts in a reverse splay.

Referring to FIGS. 32 and 33, a support member 80 is depicted for illustrative purposes. The support member 80 is shown in plan view in FIG. 32, and in side view in FIG. 33. It will be understood that the support member 80 in FIGS. 32 and 33 is merely representative of a variety of support members, and that the features discussed herein with respect to FIGS. 32 and 33 may be applicable to various different embodiments of the support member. It will be understood that the support member 80 may be configured to receive roof bolts 18 in various different configurations. For example, the support member 80 may be configured to allow the roof bolts 18 to splay in a radial direction 102, or a non-radial direction 104 with respect to the opening 34*k*, or center of the support member 80. Also, the support member 80 may be configured to allow the roof bolts 18 to extend in a parallel direction, or a combination of radial, non-radial, and/or parallel directions. Moreover, as shown in FIG. 33, the support member 80 may be configured to allow the roof bolts 18 to extend in a splayed direction 106 towards each other such that the roof bolts 18 may cross each other at a certain location. This configuration may sometimes be referred to as a reverse splay, or a splay in a reverse direction. It will also be understood that the roof bolts 18 may have the same or different lengths and sizes installed within a particular support member 80. Accordingly, it will be understood that the roof bolts 18 may extend in a variety of different configurations within the scope of the present disclosure.

Figure 34:
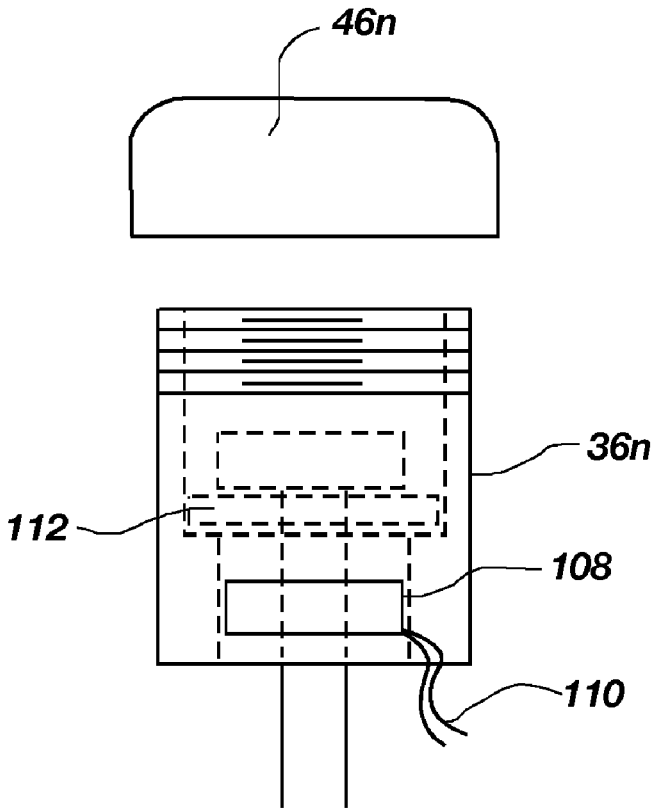
FIG. 34 is a side view of an embodiment of a socket and cover in which the socket contains a strain gauge.

Referring now to FIG. 34, a side view is shown of an embodiment of a socket 36*n* and cover 46*n*. A roof bolt 18 having a bolt head 24 may be installed on a washer 112 within the socket 36*n* in a manner as described above. One or more strain gauges 108, or other signaling devices, may be disposed on the socket 36*n* to provide a mechanism for monitoring the amount of load on or other characteristic of the bolt 18 or socket 36*n*, or other component of the support member. It will be understood that the strain gauge 108 may be formed in any manner known to those skilled in the art for detecting loads. Moreover, the gauges 108 may be positioned as desired to obtain data at a specified location. The strain gauge 108 may include wires 110 extending to instrumentation or recording or display equipment. Alternatively, the strain gauge 108 may provide wireless output. It will be understood that the load on the strain gauge 108 may be read directly with an instrument or information from the gauge 108 may be transmitted to a storage device for remote readout. Some embodiments of the present disclosure may also allow transmitting and reading of data from the gauge 108 over wire or wire-less networks such as the Internet. It will be understood that other signaling devices known in the art may be used to monitor conditions at the support members within the scope of the present disclosure.

Figure 35:
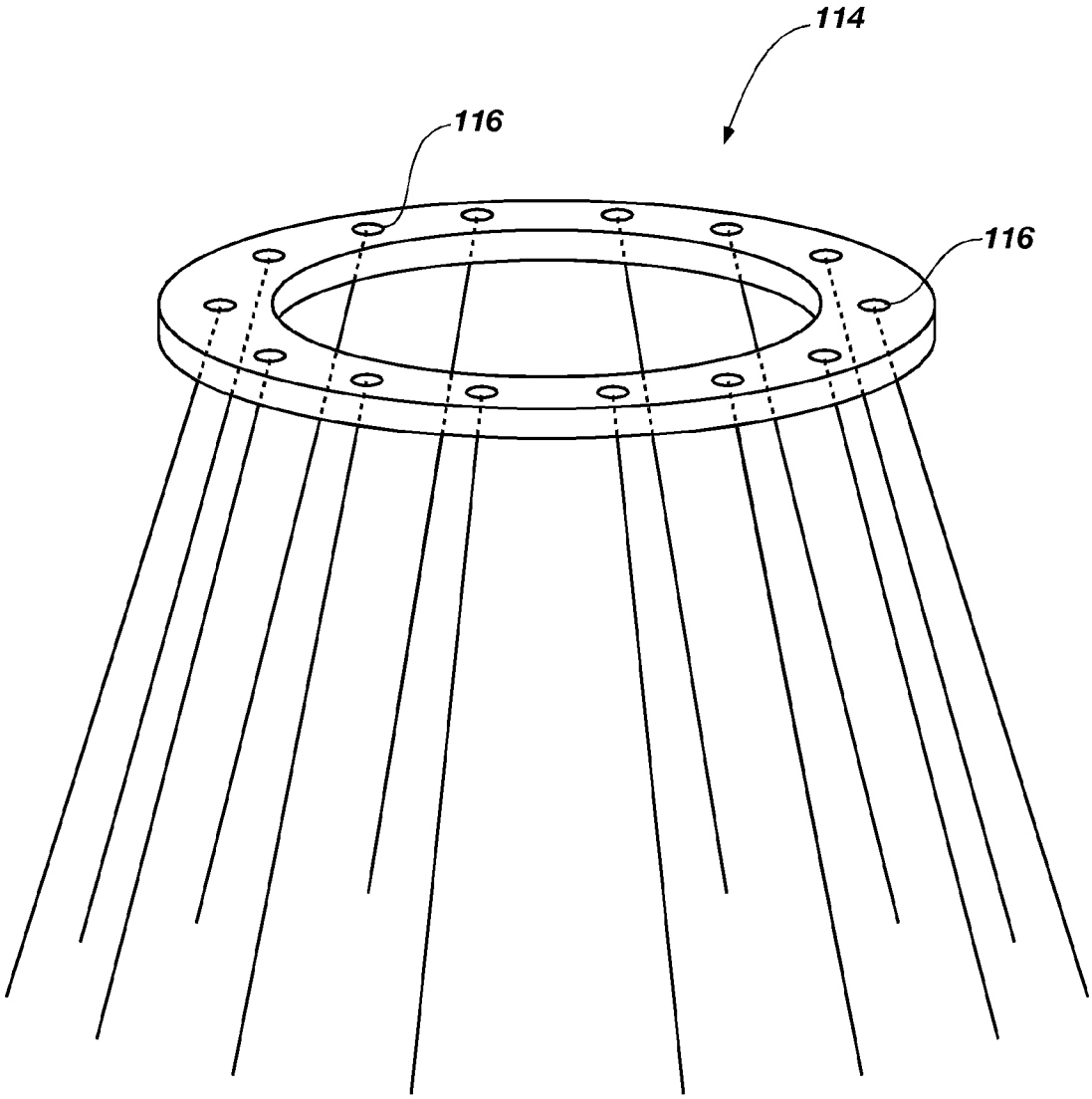
FIG. 35 is a perspective view of a further embodiment plate.

Referring now to FIG. 35, a perspective view of an alternative embodiment support member or anchor plate is shown, indicated generally at 114. The anchor plate 114 may form a ring or base for anchoring any variety of structures, such as power poles, light poles, or windmills, for example. The anchor plate 114 may be set on rock or other material with bolts 18 drilled into the material through the anchor plate openings 116. It will be understood that the shape and configuration of the anchor plate 114, as well as the anchor plate openings 116 may vary within the scope of the present disclosure. Moreover, it will be understood that the anchor plate 114 may be placed against a ceiling, floor or wall, such that the anchor plate 114 may be oriented in any desired position with respect to surface or subsurface materials. Accordingly, the anchor plate 114 may provide a support for structures as an alternative to prior art supports in which a concrete base is poured over anchor bolts to embed the bolts in the concrete.

It will be appreciated that the structure and apparatus disclosed herein is merely one example of a means for directing bolts in a splayed configuration, and it should be appreciated that any structure, apparatus or system for directing bolts which performs functions the same as, or equivalent to, those disclosed herein are intended to fall within the scope of a means for directing bolts in a splayed configuration, including those structures, apparatuses or systems for directing bolts which are presently known, or which may become available in the future. Anything which functions the same as, or equivalently to, a means for directing bolts in a splayed configuration falls within the scope of this element.

In accordance with the features and combinations described above, a useful method for supporting a subsurface material includes the steps of:

attaching a support member to a surface of the material, the support member comprising a plurality of sockets, each of the sockets being configured for receiving a bolt therethrough;

installing a first bolt in the material through one of the sockets at a first pre-determined angle defined by the one of the sockets;

installing a second bolt in the material through another one of the sockets at a second pre-determined angle defined by the other one of the sockets.

Those having ordinary skill in the relevant art will appreciate the advantages provided by the features of the present disclosure. For example, it is a feature of the present disclosure to provide a support member that is simple in design and manufacture. Another feature of the present disclosure is to provide such a support member that is versatile in allowing different quantities of roof bolts to be used in connection with the support member, and allowing additional roof bolts to be installed at a later time in the event one or more of the roof bolts fail. It is a further feature of the present disclosure, in accordance with one aspect thereof, to provide a support member that provides increased support capabilities, in that more than one bolt may be installed in close proximity to create a higher load carrying capacity than a single bolt. It is another feature of the present disclosure to provide a support member that allows a plurality of roof bolts to be installed in a splayed manner in which the heads of the roof bolts may be in close proximity to each other, whereas the ends of the roof bolts may be spaced further apart, for supporting sub-surface materials that may not otherwise be supported. It is an additional feature of the present disclosure to provide a support member that may enhance safety and may prevent roof bolts from being ejected from the support member. It is another feature of the present disclosure to provide a support member that may provide a visual indicator as to a condition of the roof bolts. It is a further feature of the present disclosure to provide a support member that may be used to withstand the loading of high-strength cable roof bolts and bolts of various different varieties. It is another feature of the present disclosure to provide a support member that may be useful for stabilizing materials or slopes from above the ground.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A support member for supporting a subsurface material, said support member comprising:

a base defining a base surface for contacting a surface of said material;

a plurality of sockets extending from said base, each of said plurality of sockets defining an opening for receiving a bolt therethrough for extending into said material to support said material.

2. The support member of claim 1, wherein said base comprises a substantially planar central portion.

3. The support member of claim 2, wherein said base comprises a plurality of extensions surrounding said central portion.

4. The support member of claim 3, wherein said plurality of extensions project at an angle of less than 25 degrees with respect to said central portion.

5. The support member of claim 4, wherein said angle is approximately 5 degrees.

6. The support member of claim 1, wherein said base comprises at least one fastener opening for receiving a fastener for fastening the support member to said surface of said material.

7. The support member of claim 1, wherein said plurality of sockets comprises four sockets.

8. The support member of claim 1, wherein said plurality of sockets comprises three sockets.

9. The support member of claim 1, wherein said plurality of sockets comprises five sockets.

10. The support member of claim 1, wherein said plurality of sockets each comprise a sidewall having an interior surface and an exterior surface, said interior surface defining said opening for receiving said bolt therethrough, wherein said interior surface of said sidewall comprises a stop for abutting with a head of said bolt for limiting movement of said bolt into said socket.

11. The support member of claim 1, further comprising a cover for covering at least one of said plurality of sockets.

12. The support member of claim 11, wherein said cover is removably attachable to said at least one of said plurality of sockets by a threaded engagement.

13. The support member of claim 11, wherein said cover is removably attachable to said at least one of said plurality of sockets by a fastener.

14. The support member of claim 11, wherein said cover comprises a pin.

15. The support member of claim 11, wherein said cover comprises cover openings, and wherein said cover is rotatable such that said cover openings may be aligned with said plurality of sockets, and said cover may be rotated such that said cover openings may not be in alignment with said plurality of sockets to thereby block said bolts from exiting said sockets.

16. The support member of claim 1, wherein said support member comprises a cover for covering said plurality of sockets, said cover being disposed on a post such that said cover extends substantially parallel to and spaced apart from said base.

17. The support member of claim 11, wherein said cover comprises an indicator for indicating if said bolt has broken.

18. The support member of claim 1, wherein said base comprises a substantially planar central portion and a plurality of extensions surrounding said central portion;

wherein said plurality of extensions project at an angle of less than 25 degrees with respect to said central portion;

wherein said angle is approximately 5 degrees;

wherein said base comprises at least one fastener opening in said central portion for receiving a fastener for fastening said support member to said surface of said material;

wherein said plurality of sockets comprises four sockets;

wherein said plurality of sockets each comprise a sidewall having an interior surface and an exterior surface, said interior surface defining said opening for receiving said bolt therethrough, wherein said interior surface of said sidewall comprises a stop for abutting with a head of said bolt for limiting movement of said bolt into said socket;

wherein said support member further comprises a cover for covering at least one of said plurality of sockets;

wherein said cover is removably attachable to said at least one of said plurality of sockets by a threaded engagement.

19. The support member of claim 1, wherein said base is substantially planar.

20. The support member of claim 19, further comprising a tapered washer circumscribing each of said plurality of sockets for supporting said plurality of sockets on said base.

21. The support member of claim 20, wherein a washer is disposed on said base opposite each of said plurality of tapered washers.

22. The support member of claim 19, wherein said base comprises an inclined surface for joining with each of said plurality of sockets.

23. The support member of claim 22, wherein a connector connects each of said plurality of sockets with said base.

24. The support member of claim 23, wherein each of said plurality of sockets comprises a threaded interior surface, and wherein said connector comprises a threaded exterior surface.

25. A support member for supporting a subsurface material, said support member comprising:

a base defining a central portion having a base surface for contacting a surface of said material;

at least one socket extending from said base, said at least one socket being configured for receiving a bolt therethrough;

wherein said at least one socket comprises a plurality of sockets;

wherein said at least one socket extends at a non perpendicular angle with respect to said base surface;

wherein said at least one socket is fixedly attached to said base.

26. The support member of claim 25, wherein said central portion is substantially planar, and a plurality of extensions surround said central portion.

27. The support member of claim 26, wherein said plurality of extensions project at an angle of less than 25 degrees with respect to said central portion.

28. The support member of claim 25, wherein said at least one socket comprises a sidewall having an interior surface and an exterior surface, said interior surface defining an opening for receiving said bolt therethrough, wherein said interior surface of said sidewall comprises a stop for abutting with a head of said bolt for limiting movement of said bolt into said socket.

29. The support member of claim 25, further comprising a cover for covering said at least one socket.

30. The support member of claim 25, further comprising a tapered washer circumscribing said at least one socket.

31. A support member for supporting a subsurface material, said support member comprising:

a base for defining a base surface for contacting a surface of said material;

at least one socket extending from said base, said at least one socket defining an opening for receiving a bolt therethrough; and a cover for preventing said bolt from exiting said at least one socket.

32. The support member of claim 31, wherein said at least one socket comprises a plurality of sockets extending from said base.

33. The support member of claim 31, wherein said base comprises a substantially planar central portion, and a plurality of extensions surround said central portion.

34. The support member of claim 31, wherein said at least one socket extends at a non-perpendicular angle with respect to said surface of said base.

35. The support member of claim 31, wherein said base comprises at least one fastener opening for receiving a fastener for fastening said support member to said surface of said material.

36. The support member of claim 31, wherein said at least one socket comprises a sidewall having an interior surface and an exterior surface, wherein said interior surface of said sidewall comprises a stop for abutting with a head of said bolt for limiting movement of said bolt into said socket.

37. The support member of claim 31, further comprising a tapered washer circumscribing said at least one socket.

38. The support member of claim 31, wherein said cover is removably attachable to said at least one socket.

39. The support member of claim 31, wherein said cover comprises at least one cover opening, and wherein said cover is rotatable such that said at least one cover opening may be aligned with said at least one socket, and said cover may be rotated such that said at least one cover opening may not be in alignment with said at least one socket to thereby block said bolt from exiting said at least one socket.

40. The support member off claim 31, wherein said base comprises an inclined surface for joining with said at least one socket.

41. The support member of claim 31, wherein said cover is removably attachable to said at least one of said plurality of sockets by a threaded engagement.

42. The support member of claim 31, wherein said cover is removably attachable to said at least one of said plurality of sockets by a fastener.

43. The support member of claim 31, wherein said cover comprises a pin.

44. The support member of claim 31, wherein said cover is disposed on a post such that said cover extends substantially parallel to and spaced apart from said base.

45. The support member of claim 31, wherein said cover comprises an indicator for indicating if said bolt has broken.

46. The support member of claim 31, wherein said indicator comprises a pin moveable through said cover for contacting said bolt.

47. A support member for supporting a subsurface material, said support member comprising:

a base; and at least one socket disposed on said base; said at least one socket comprising a sidewall having an interior surface and an exterior surface, said interior surface defining an opening for receiving a bolt therethrough for extending in the material;

wherein said interior surface of said sidewall comprises a stop for abutting with a head of said bolt for limiting movement of said bolt into said socket.

48. The support member of claim 47, wherein said base comprises a base surface for contacting said surface of said material, and wherein said at least one socket extends at a non-perpendicular angle with respect to said base surface.

49. The support member of claim 47, wherein said at least one socket comprises a plurality of sockets.

50. The support member of claim 47, wherein said base comprises a substantially planar central portion and a plurality of extensions surround said central portion, said plurality of extensions projecting at an angle of approximately 5 degrees with respect to said central portion.

51. The support member of claim 47, wherein said base comprises at least one fastener opening for receiving a fastener for fastening said support member to said surface of said material.

52. The support member of claim 47, further comprising a cover for covering said at least one socket.

53. A support member for supporting a subsurface material, said support member comprising:

a base, said base comprising a substantially planar central portion and a plurality of extensions surrounding said central portion; and a socket disposed on each of said plurality of extensions for receiving a bolt therethrough;

wherein each of said plurality of extensions are disposed at an angle with respect to said base.

54. The support member of claim 53, wherein said angle is less than 25 degrees.

55. The support member of claim 54, wherein said angle is approximately 5 degrees.

56. The support member of claim 53, wherein said base comprises at least one fastener opening for receiving a fastener for fastening the support member to said surface of said material.

57. The support member of claim 53, further comprising a cover for covering said socket.

58. The support member of claim 53, wherein said socket comprises a sidewall having an interior surface and an exterior surface, said interior surface defining an opening for receiving said bolt therethrough, wherein said interior surface of said sidewall comprises a stop for abutting with a head of said bolt for limiting movement of said bolt into said socket.

59. A support member for supporting a subsurface material, said support member comprising:

a base for defining a base surface for contacting a surface of said material;

means disposed on said base for directing a plurality of bolts in a splayed configuration.

60. The support member of claim 59, wherein said means for directing a plurality of bolts in a splayed configuration comprises a plurality of sockets extending from said base, each of said plurality of sockets defining an opening for receiving one of said bolts therethrough for extending into said material.

61. The support member of claim 60, wherein said plurality of sockets extend at a non-perpendicular angle with respect to said surface of said base.

62. The support member of claim 61, wherein said angle is approximately 85 degrees.

63. The support member of claim 59, wherein said base comprises at least one fastener opening for receiving a fastener for fastening the support member to said surface of said material.

64. The support member of claim 60, wherein said plurality of sockets each comprise a sidewall having an interior surface and an exterior surface, said interior surface defining said opening for receiving one of said bolts therethrough, wherein said interior surface of said sidewall comprises a stop for abutting with a head of one of said bolts for limiting movement of said bolt.

65. The support member of claim 60, further comprising a cover for covering at least one of said plurality of sockets.

66. The support member of claim 59, wherein said base is substantially planar.

67. The support member of claim 59, wherein said base comprises a substantially planar central portion and a plurality of extensions surrounding said central portion, wherein said plurality of extensions project at an angle of less than 25 degrees with respect to said central portion.

68. The support member of claim 59, wherein said means disposed on said base for directing a plurality of bolts in a splayed configuration directs said plurality of bolts in a radial direction with respect to a center of said support member.

69. The support member of claim 59, wherein said means disposed on said base for directing a plurality of bolts in a splayed configuration directs said plurality of bolts in a non-radial direction with respect to a center of said support member.

70. The support member of claim 59, wherein said means disposed on said base for directing a plurality of bolts in a splayed configuration directs said plurality of bolts in a direction towards each other as said bolts extend away from said base.

71. The support member of claim 59, wherein said base comprises a ring.

* * * * *